US008951178B2

(12) United States Patent
Kurosawa et al.

(10) Patent No.: US 8,951,178 B2
(45) Date of Patent: Feb. 10, 2015

(54) PLASTIC POUCH AND MANUFACTURING METHOD THEREFOR

(75) Inventors: Kazuyuki Kurosawa, Yokohama (JP); Keizou Kanzaki, Yokohama (JP); Shie Nishimoto, Yokohama (JP); Takwto Sakurai, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 13 days.

(21) Appl. No.: 13/418,303

(22) Filed: Mar. 12, 2012

(65) Prior Publication Data

US 2012/0263400 A1 Oct. 18, 2012

Related U.S. Application Data

(62) Division of application No. 11/660,154, filed as application No. PCT/JP2005/015965 on Aug. 25, 2005, now Pat. No. 8,157,445.

(30) Foreign Application Priority Data

Aug. 25, 2004 (JP) ..... 2004-244606
Jun. 28, 2005 (JP) ..... 2005-188351
Jun. 28, 2005 (JP) ..... 2005-188352

(51) Int. Cl.
*B31B 1/00* (2006.01)

(52) U.S. Cl.
USPC ..... 493/186; 493/276

(58) Field of Classification Search
USPC ..... 493/186, 153, 269, 272, 276
See application file for complete search history.

(56) References Cited

U.S. PATENT DOCUMENTS

| | | | | |
|---|---|---|---|---|
| 3,937,396 | A * | 2/1976 | Schneider | 383/94 |
| 4,141,487 | A | 2/1979 | Faust et al. | |
| 4,571,337 | A * | 2/1986 | Cage et al. | 426/107 |
| 5,039,001 | A * | 8/1991 | Kinigakis et al. | 229/120 |
| 5,139,151 | A * | 8/1992 | Chelak | 206/523 |
| 5,587,192 | A * | 12/1996 | Beizermann | 426/118 |
| 2003/0123758 | A1 * | 7/2003 | Mita et al. | 383/38 |
| 2006/0257056 | A1 * | 11/2006 | Miyake et al. | 383/103 |

FOREIGN PATENT DOCUMENTS

EP 0256791 A2 2/1988

OTHER PUBLICATIONS

Supplementary European Search Report Dated Dec. 12, 2012.

* cited by examiner

*Primary Examiner* — Sameh H. Tawfik
(74) *Attorney, Agent, or Firm* — Hedman & Costigan, P.C.; James V. Costigan; Kathleen A. Costigan

(57) ABSTRACT

At least one of an obverse surface film and reverse surface film, which are used to together constitute a plastic pouch, is folded back across the entire width of the plastic pouch, and peripheral edge portions of the pouch are heat-sealed, to thereby form, on at least one position, a folded-back section communicating with the body of the pouch.

14 Claims, 21 Drawing Sheets

PLASTIC POUCH AND MANUFACTURING METHOD THEREFOR

This application is a divisional application of application Ser. No. 11/660,154, of Aug. 3, 2007, which is a Section 371 Application of PCT/JP2005/15965, filed Aug. 25, 2005 which claims the benefit of JP 2004-244606, filed Aug. 25, 2004; JP 2005-188351, filed Jun. 28, 2005 and JP 2005-188352, filed Jun. 28, 2005.

TECHNICAL FIELD

The present invention relates to flat-type plastic pouches formed by heat-sealing peripheral edge portions of plastic films constituting front and back surfaces, i.e. obverse and reverse surfaces, of the pouches, and methods for manufacturing the plastic pouches. The plastic pouch of the present invention can be suitably used as a microwave-cooking pouch having contents, such as retort food in liquid or solid form or in a mixture of liquid and solid materials, packed therein.

BACKGROUND ART

When a packaging bag, having retort food, frozen food or the like packed therein in a hermetically sealed state, is heated by a microwave oven, the pressure in the interior of the packaging bag increases due to vapor etc. produced from the heated contents, and thus, the packaging bag may burst so that the packed contents scatter and soil the interior of the microwave oven and even inflict harm, such as a burn, on a human body.

In order to avoid the aforementioned inconveniences, it has been conventional to partly open the packaging bag or make a hole in the body of the packaging bag before the packaging bag is subjected to heating by a microwave oven, so as to discharge vapor etc. produced within the bag and thereby prevent the bag from bursting.

However, such a conventional solution would require extra time and labor on the part of general consumers. Also, because the vapor produced due to the heating by the microwave oven is immediately discharged outside the packaging bag, a steaming effect by the vapor would be considerably reduced so that the food undesirably deteriorates in flavor.

To avoid the problem, a variety of plastic pouches have so far been proposed which are equipped with a mechanism that automatically opens, in response to an increase in the interior pressure of the pouch due to heating by a microwave oven, so that the increased interior pressure is allowed to automatically escape from the interior of the pouch.

As the plastic pouches equipped with such an automatically-opening mechanism, there have been known various types of plastic pouches, such as standing-type pouches that are heated in a self-erected position within a microwave oven (see, for example, Japanese Patent Application Laid-open Publication Nos. 2002-249176 and 2003-192042), flatly-laid-type pouches, such as branch-type pouches equipped with an automatically-opening mechanism provided in a flat bag or branch portion of the bag, that are heated in a flatly-laid position within a microwave oven (see, for example, Japanese Patent Application Laid-open Publication Nos. 2002-80072 and 2001-106270, and Japanese Patent Publication No. HEI-8-25583).

Of these pouches, the most superior in terms of productivity and cost is the flat-type pouch. However, because the opening portion of the flat-type pouch can not be held stably at a high position during cooking by the microwave oven and after the pouch automatically opens due to an increase in the interior pressure, the flat-type pouch would present the inconvenience that the contents of the pouch undesirably spout or leak out of the automatically-opening portion.

For this reason, it has heretofore been proposed to employ an auxiliary device, such as an item packaging box, for holding the opening portion of the flat-type microwave-oven-cooking pouch (see Japanese Patent Application Laid-open Publication No. 2003-170930); however, the use of the auxiliary device would require cumbersome operation and lead to an increase in the cost.

DISCLOSURE OF THE INVENTION

In view of the foregoing, it is an object of the present invention to provide a flat-type plastic pouch which can be manufactured efficiently at low cost and which, when heated for cooking in a flatly-laid position within a microwave oven, allows its opening portion, automatically opening in response to an increase in the interior pressure of the pouch, to be stably held at a high position, without using any auxiliary device.

It is another object of the present invention to provide a plastic pouch manufacturing method which can manufacture a plastic pouch with a high efficiency.

It is still another object of the present invention to provide a plastic pouch manufacturing/packing method which can manufacture a plastic pouch and pack contents into the pouch with a high efficiency.

As a result of deliberate study by the inventors etc., it has been found that the above-discussed inconveniences can be effectively avoided by folding at least one of pouch-forming films across the entire width of a pouch to be manufactured and then heat-sealing peripheral edge portions of the films to thereby form a folded-back section communicating with the body of the pouch.

Namely, the following structural arrangements in items 1-12 below are employed in the plastic pouch of the present invention.

1. A plastic pouch characterized in that a folded-back section, communicating with the body of the plastic pouch being formed, is formed on at least one position of the plastic pouch by folding back, across the entire width of the pouch, at least one of an obverse surface film and reverse surface film forming the pouch and then heat-sealing peripheral edge portions of the pouch.

2. The plastic pouch as set forth in item 1 above, which is characterized in that the folded-back sections are formed on both of the obverse surface film and the reverse surface film.

3. The plastic pouch set forth in item 1 or 2 above, which is characterized in that each of the folded-back sections is formed adjacent to one end of the plastic pouch.

4. The plastic pouch set forth in item 1 or 2 above, which is characterized in that the folded-back sections are formed adjacent to opposite ends of the plastic pouch.

5. The plastic pouch set forth in any one of items 1-4 above, which is characterized in that the folded-back section is formed by folding back the surface film in a Z configuration.

6. The plastic pouch set forth in any one of items 1-4, which is characterized in that the folded-back section is formed by folding back the surface film in a Z configuration and then further folding back the surface film in a reverse Z configuration.

7. The plastic pouch set forth in any one of items 1-6, which is characterized in that, in a peripheral-edge seal portion of the folded-back section, holes are formed in film layers located inwardly of outmost film layers of the obverse surface film and the reverse surface film that form peripheral-edge sealed portions of each of the folded-back sections, and the outmost film layers of the obverse surface film and the reverse surface film are heat-sealed together through the holes.

8. The plastic pouch set forth in any one of items 1-7, which is characterized by including an automatic opening mechanism formed at or near an end portion of the plastic pouch located near the folded-back section, and characterized in that the automatic opening mechanism automatically opens as the plastic pouch is heated by a microwave oven.

9. The plastic pouch set forth in item 8, which is characterized in that the automatic opening mechanism is formed adjacent to a peripheral-edge sealed portion at the end portion of the plastic pouch.

10. The plastic pouch set forth in item 9, which is characterized in that the automatic opening mechanism is formed by providing, on the peripheral-edge sealed portion at the end portion of the plastic pouch, a projection having a distal end portion projected toward an interior of the plastic pouch.

11. The plastic pouch set forth in item 8, which is characterized in that the automatic opening mechanism is formed separately from a peripheral-edge sealed portion at an end portion of the plastic pouch.

12. The plastic pouch set forth in any one of items 8-11, which is characterized in that the automatic opening mechanism is in the form of a vapor-evacuating seal section having a weakened portion.

The plastic pouch of the present invention can be manufactured efficiently at low cost similar to the cost required of the conventional flat-type pouch, without additional components and manufacturing steps required of the standing-type and branch-type pouches. Further, when the plastic pouch of the invention is to be horizontally laid flat in a microwave oven so as to be heated for cooking, the automatic opening portion that automatically opens in response to an increase in the interior pressure of the pouch can be stably held at a relatively high position without using any auxiliary device, with the result that it is possible to prevent unwanted blowout or leakage of the contents out of the opening portion.

Further, it has been fount even more advantageous to fix the widthwise opposite ends of the folded-back section to the body of the pouch, in order to prevent the plastic pouch from being damaged by the heat sealing so that the automatic opening portion can be reliably held at a high position, or, in order to prevent the folded-back section from projecting outwardly for possible interference or hindrance during packing of the contents into the pouch and distribution or transport of the pouch after packing of the contents (even in the case where no such automatic opening portion is provided). Thus, the inventors have completed an efficient method for manufacturing such an advantageous plastic pouch.

The following structural arrangements in items 13-26 are employed in the plastic pouch manufacturing method of the present invention.

13. A method for manufacturing a plastic pouch including a widthwise folded-back section provided on at least one position of an obverse surface member and reverse surface member in communication with an interior of the plastic pouch, peripheral edge portions of the pouch being heat-sealed, and opposite widthwise ends of the folded-back section, located outwardly of sealed portions of the folded-back section, being fixed to the obverse surface member or the reverse surface member, characterized in that the method forms the folded-back section by folding one portion of at least one of the obverse surface member and the reverse surface member.

According to the plastic pouch manufacturing method, in manufacturing a plastic pouch where a widthwise folded-back section is provided, on at least one position of the obverse surface member and reverse surface member, in communication with the interior of the plastic pouch, the peripheral edge portions of the pouch are heat-sealed, and where the opposite widthwise ends of the folded-back section, located outwardly of sealed portions of the folded-back section, are fixed to the obverse surface member or the reverse surface member, the folded-back section is formed by folding one portion of at least one of the obverse surface member and the reverse surface member. Thus, it is possible to readily form the folded-back section on the obverse or reverse surface member which is in the form of a web fed both continuously and intermittently.

14. The method for manufacturing a plastic pouch set forth in item 13, which is characterized in that formation of the folded-back section is performed on the at least one of the obverse surface member and the reverse surface member that are fed continuously.

According to the plastic pouch manufacturing method, the formation of the folded-back section is performed on at least one of the obverse and reverse surface members being fed in a continuous manner, so that the folded-back section can also be readily formed from the continuously-fed obverse and/or reverse surface members.

15. The method for manufacturing a plastic pouch set forth in item 13, which is characterized in that formation of the folded-back section is performed on the at least one of the obverse surface member and the reverse surface member after continuous feeding of the at least one of the obverse surface member and the reverse surface member is converted into intermittent feeding.

According to the plastic pouch manufacturing method, the formation of the folded-back section is performed on at least one of the obverse and reverse surface members being fed in an intermittent manner, so that the folded-back section can also be readily formed from the intermittently-fed obverse and/or reverse surface members.

16. The method for manufacturing a plastic pouch set forth in any one of items 13-15, which is characterized in that formation of the folded-back section is performed on two portions of any one of the obverse surface member and the reverse surface member, or on one portion of each of the obverse surface member and the reverse surface member, so as to manufacture plastic pouches in two rows.

According to the plastic pouch manufacturing method, the folded-back section is formed on two portions of any one of the obverse surface member and the reverse surface member, or on one portion of each of the obverse surface member and the reverse surface member, so as to manufacture plastic pouches in two rows.

17. The method for manufacturing a plastic pouch set forth in any one of items 13-16, which is characterized in that the plastic pouch is manufactured using, in addition to the obverse surface member and the reverse surface member, a folding-back surface member to be used for forming the folded-back section.

According to the plastic pouch manufacturing method, the plastic pouch is manufactured using not only the obverse surface member and the reverse surface member, but also a folding-back surface member to be used for forming the folded-back section. Thus, it is possible to manufacture a plastic pouch from a combination of not only the obverse and reverse surface members but also the folding-back surface members, using a conventional bag making machine for standing-type pouches.

18. The method for manufacturing a plastic pouch set forth in any one of items 13-15, which is characterized in that formation of the folded-back section is performed on three portions of any one of the obverse surface member and the reverse surface member, or on two portions of any one of the obverse surface member and the reverse surface member and on one portion of the other of the obverse surface member and the reverse surface member, so as to manufacture plastic pouches in three rows.

According to the plastic pouch manufacturing method, the folded-back section is formed on three portions of any one of the obverse surface member and the reverse surface member, or on two portions of any one of the obverse surface member and the reverse surface member and on one portion of the other of the surface members, so as to manufacture plastic pouches in three rows. By thus forming the folded-back sections on three portions, the present invention can facilitate three-row manufacturing where plastic pouches are manufactured in three rows separate from one another in a width direction of the surface members.

19. The method for manufacturing a plastic pouch set forth in any one of items 13-18, which is characterized in that the folded-back sections of individual plastic pouches to be manufactured are formed using the same folding direction or different folding directions or a combination of the same folding direction and different folding directions.

According to the plastic pouch manufacturing method, the folded-back sections of the individual plastic pouches are formed using the same folding direction or different folding directions or a combination of the same folding direction and different folding directions. With such arrangements, the present invention can manufacture plastic pouches irrespective of the respective folded-back directions of the folded-back sections.

20. The method for manufacturing a plastic pouch set forth in any one of items 13-19, which is characterized in that formation of the folded-back section is performed at differentiated timing.

According to the plastic pouch manufacturing method, the formation of the folded-back section is performed at differentiated timing, or one another. By thus performing the formation of the folded-back sections at differentiated times rather than at the same time, the present invention allows the folded-back section to be readily formed even on the surface member subjected to tension.

21. The method for manufacturing a plastic pouch set forth in any one of items 13-20, which is characterized in that the opposite widthwise ends of the folded-back section, located outwardly of the sealed portions of the folded-back section, are fixed, by forming holes in two portions of the surface members sandwiched between the folded-back sections and then heat-sealing the opposite widthwise ends.

According to the plastic pouch manufacturing method, fixation of the opposite widthwise ends of the folded-back section, located outwardly of the sealed portions of the folded-back section, is effected by forming holes in two portions of the surface members between the folded-back sections and then heat-sealing the opposite widthwise ends. Thus, the opposite widthwise ends can be fixed together by heat-sealing, through the holes formed in the portions of the two surface members, with the inner surfaces of the upper and lower surface members placed in contact with each other.

22. The method for manufacturing a plastic pouch set forth in item 21, which is characterized in that the holes are formed in each of the two portions of the surface members or in the folding-back surface member, or formed to extend over the two portions of the surface members.

According to the plastic pouch manufacturing method, the above-mentioned holes are formed in each of the two portions of the surface members or in the folding-back surface member, or formed to extend over the two portions of the surface members. Thus, the opposite widthwise ends can be fixed together, even through the holes formed to extend over the two portions of the surface members, with the inner surfaces of the upper and lower surface members placed in contact with each other.

23. The method for manufacturing a plastic pouch set forth in item 21 or 22, which is characterized in that formation of the holes is performed during continuous feeding or intermittent feeding of the obverse surface member and the reverse surface member or of the folding-back surface member.

According to the plastic pouch manufacturing method, formation of the holes is performed during continuous feeding or intermittent feeding of the obverse and reverse surface members or of the folding-back surface member. With such arrangements, the holes can be formed to appropriately fix the folded-back section irrespective of whether the surface members are fed continuously or intermittently.

24. The method for manufacturing a plastic pouch set forth in any one of items 13-20, which is characterized in that fixation of the opposite widthwise ends of the folded-back section, located outwardly of the sealed portions of the folded-back section, is performed, by any of an adhesive agent, mechanical fixation and welding.

According to the plastic pouch manufacturing method, the fixation of the opposite widthwise ends of the folded-back section, located outwardly of the sealed portions of the folded-back section, is performed, by any of an adhesive agent, mechanical fixation and welding. Thus, the opposite widthwise ends of the folded-back section can be fixed appropriately by any one of the adhesive, mechanical fixation means, such as a stapler or rivet, and welding based on supersonic sealing or the like.

25. The method for manufacturing a plastic pouch set forth in any one of items 13-24 which further comprises forming an automatic opening portion that can open in response to a vapor pressure within the pouch is formed inwardly of a heat-sealed peripheral edge portion of the plastic pouch.

According to the plastic pouch manufacturing method, the automatic opening portion that can open in response to a vapor pressure within the pouch is formed inwardly of the heat-sealed peripheral edge portion of the plastic pouch. With such arrangements, the present invention can readily form the automatic opening portion and thus facilitates heating of the pouch by a microwave oven.

26. The method for manufacturing a plastic pouch set forth in item 25, which is characterized in that the automatic opening portion is formed by forming a heat-sealed portion simultaneously with heat-sealing of the peripheral edge portion of the pouch and then forming a through-hole in the heat-sealed portion.

According to the plastic pouch manufacturing method, the automatic opening portion is formed by forming a heat-sealed portion simultaneously with heat-sealing of the peripheral edge portion of the pouch and then forming a through-hole in the heat-sealed portion. The through-hole formed in the heat-sealed portion can be provided as the automatic opening portion.

Further, the following structural arrangements in items 27-32 below are employed in the plastic pouch manufacturing/packing method.

27. The method for manufacturing a plastic pouch and packing contents into the plastic pouch, the plastic pouch including a widthwise folded-back section provided on one of an obverse surface member and reverse surface member in communication with an interior of the plastic pouch, opposite widthwise ends of the folded-back section being fixed to the obverse surface member and the reverse surface member, characterized in that the method comprises: superposing opposite widthwise end portions of a plastic film in such a way as to permit formation of the folded-back section and a leading-end seal portion of the folded-back section and pillow-sealing only an end edge portion of the superposed section of the plastic film to provide a substantially-cylindrical structure; then folding a proximal end portion of the superposed section and fixing the opposite widthwise end portions to thereby form the folded-back section; performing leading-end sealing to close a leading end of the substantially-cylindrical structure and then packing contents into the substantially-cylindrical structure; and performing trailing-end sealing to close a trailing end of the substantially-cylindrical structure and then cutting off the sealed substantially-cylindrical structure.

According to the plastic pouch manufacturing/packing method, in manufacturing a plastic pouch which includes a widthwise folded-back section provided, on one of the obverse surface member and reverse surface member, in communication with the interior of the plastic pouch and where opposite widthwise ends of the folded-back section are fixed to the obverse surface member and the reverse surface member, and in packing contents into the pouch, the method comprises: superposing opposite widthwise end portions of a plastic film in such a way as to permit formation of the folded-back section and a leading-end seal portion of the folded-back section and pillow-sealing only an end edge portion of the superposed section of the plastic film to provide a substantially-cylindrical structure; then folding a proximal end portion of the superposed section and fixing the opposite widthwise end portions to thereby form the folded-back section; performing leading-end sealing to close a leading end of the substantially-cylindrical structure and then packing contents into the substantially-cylindrical structure; and performing trailing-end sealing to close a trailing end of the substantially-cylindrical structure and then cutting off the sealed substantially-cylindrical structure. With the arrangement that the opposite widthwise end portions are superposed on each other and sealing of the folded-back section and leading end by pillow-sealing, the present invention can manufacture plastic pouches with folded-back sections and also pack contents into each of the pouches while manufacturing the pouch by packing the contents between the leading-end sealing and the trailing-end sealing.

28. The method set forth in item 27, which is characterized in that fixation of the opposite widthwise ends of the folded-back section is performed by applying an adhesive prior to folding of the superposed section.

According to the plastic pouch manufacturing/packing method, the fixation of the opposite widthwise ends of the folded-back section is performed by applying an adhesive prior to folding of the superposed section and then folding the adhesive-applied portion. Thus, the opposite widthwise ends of the folded-back section can be formed with ease by just applying an adhesive and then folding of the superposed section.

29. The method set forth in item 27, which is characterized in that fixation of the opposite widthwise ends of the folded-back section is performed by mechanical fixation or welding after folding of the superposed section.

According to the plastic pouch manufacturing/packing method, the fixation of the opposite widthwise ends of the folded-back section is performed by mechanical fixation or welding after folding of the superposed section. Thus, the opposite widthwise ends of the folded-back section can be fixed with ease by any one of the adhesive, mechanical fixation means, such as a stapler or rivet, and welding based on supersonic sealing or the like.

30. The method set forth in any one of items 27-29, which is characterized in that the trailing-end sealing of a preceding one of a pair of successive substantially-cylindrical structures and the leading-end sealing of a succeeding one of the substantially-cylindrical structures are performed simultaneously.

According to the plastic pouch manufacturing/packing method, the trailing-end sealing of the preceding substantially-cylindrical structure and the leading-end sealing of the succeeding substantially-cylindrical structure are performed simultaneously. By thus simultaneously performing the leading-end sealing and trailing-end sealing, plastic pouches can be manufactured with a high efficiency using one sealing device.

31. The method set forth in any one of items 27-30 which further comprises forming, in the obverse surface member and the reverse surface member, an automatic opening portion that can open in response to a vapor pressure within the pouch.

According to the plastic pouch manufacturing/packing method, the automatic opening portion that can open in response to a vapor pressure within the pouch is formed in the obverse surface member and the reverse surface member. The formation of such an automatic opening portion allows the increased inner pressure, caused by heating by a microwave oven, to automatically escape through the opening portion.

32. The method set forth in item 31, which is characterized in that the automatic opening portion is formed by forming a heat-sealed portion simultaneously with the leading-end sealing and trailing-end sealing and then forming a through-hole in the heat-sealed portion.

According to the plastic pouch manufacturing/packing method, the automatic opening portion is formed by forming a heat-sealed portion simultaneously with the leading-end sealing and trailing-end sealing and then forming a through-hole in the heat-sealed portion. Because the heat-sealed portion is formed simultaneously with the leading-end sealing and trailing-end sealing, it is possible to readily form the automatic opening portion.

BEST MODE FOR CARRYING OUT THE INVENTION

Figure 1:
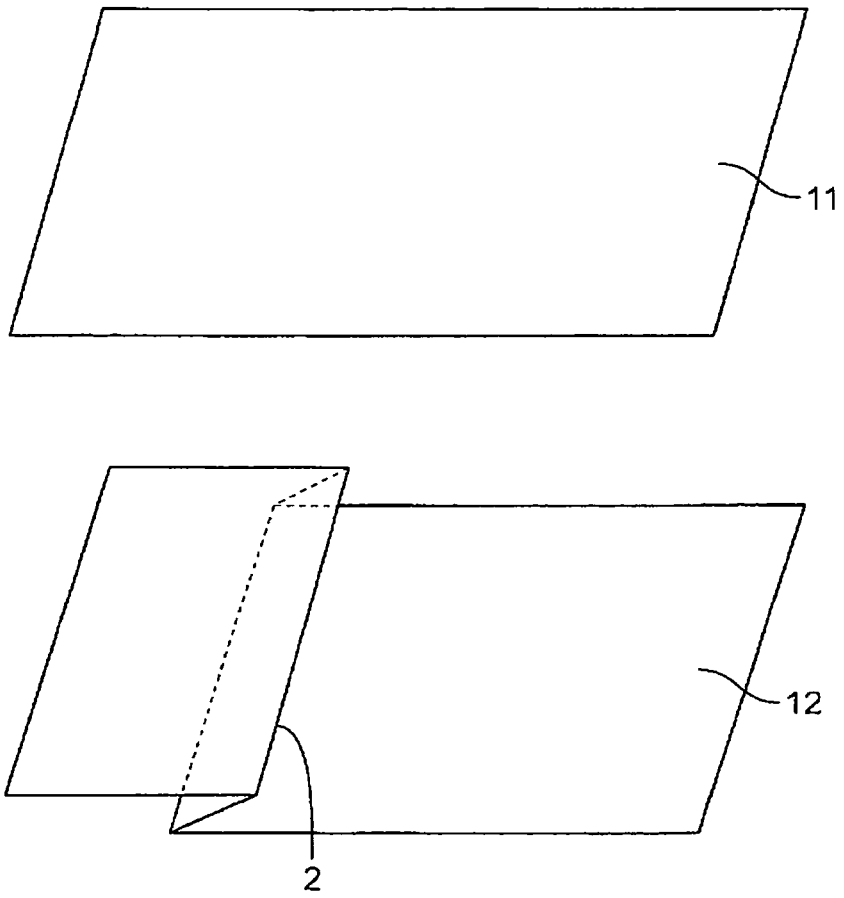
FIG. 1 is a schematic view explanatory of steps for manufacturing an embodiment of a plastic pouch of the present invention.

Plastic film forming the plastic pouch of the present invention is made of a heat-sealable plastic material that is conventionally used in manufacturing of packaging bags. Among examples of such a plastic material are a uni-layered film or sheet of heat-sealable thermoplastic resin, multi-layered film comprising heat-sealable thermoplastic resin laminated with other thermoplastic resin, etc.

As the heat-sealable plastic material, there may be used, for example, conventionally-known low-density polyethylene, linear low-density polyethylene, medium-density polyethylene, high-density polyethylene, polypropylene, propylene-ethylene copolymer, ethylene-vinyl acetate copolymer, ethylene-series unsaturated carboxylic acid, olefin-series resin graft-modified with an anhydride of the ethylene-series unsaturated carboxylic acid, polyamide or copolyamide having a relatively low melting point or softening point, polyester or copolyester resin, polycarbonate, or the like.

Further, as the other thermoplastic resin laminated with the heat-sealable plastic material, there may be used a film of heat-sealable or heat-sealable thermoplastic resin, any of various barrier films, or the like.

Among examples of the above-mentioned thermoplastic resin are polyolefin resin, such as crystalline polypropylene, crystalline propylene-ethylene copolymer, crystalline polybuten-1, crystalline poly 4-methylpentene-1, low-, medium- or high-density polyethylene, ethylene-vinyl acetate copolymer (EVA), saponified ethylene-vinyl acetate copolymer, ethylene-ethyl acrylate copolymer (EEA) or ion-cross-linked-olefin copolymer; aromatic vinyl copolymer, such as polystylene or stylene-butadiene copolymer; vinyl halide polymer, such as polyvinyl chloride or vinylidene chloride resin; polyacrylic resin; nitrile polymer, such as acrylonitrile-styrene copolymer or acrylonitrile-styrene-butadiene copolymer; polyester, such as polyethylene terephthalate or polytetramethylene terephthalate; any of various polycarbonates; fluorine-series resin; or polyacetal resin, such as polyoxymethylene. One of the above-mentioned thermoplastic resin may be used solely, or two or more types of the above-mentioned thermoplastic resin may be used in a blended combination. Further, the thermoplastic resin may be used with any of various additive agents contained therein.

Further, the various barrier films may include organic resin films, such as a silica-deposited polyester film, alumina-deposited polyester film, silica-deposited nylon film, alumina-deposited nylon film, alumina-deposited polypropylene film, carbon film-deposited polypropylene film, carbon film-deposited nylon film, binary-deposited film formed by simultaneously depositing alumina and silica on a base film, such as a polyester or nylon film, co-extruded film of nylon-6/nylon MXD(m-xylylenediamine)-6, co-extruded film of polypro-rylene/ethylene-vinyl alcohol copolymer, polyvinyl alcohol-coated polypropylene film, polyvinyl alcohol-coated nylon film, polyacrylic acid-series-resin-coated polyester film, polyacrylic acid-series-resin-coated nylon film, polyacrylic acid-series-resin-coated polypropylene film, polyglycol acid-resin-coated polyester film, polyglycol acid-resin-coated nylon film and polyglycol acid-resin-coated polypropylene film, as well as films formed by coating a hybrid coating material of organic resin or non-organic material onto a base film, such as a polypropylene film. One or more types of the above-mentioned barrier films may be used solely or in a blended combination.

Further, as the other thermoplastic resin laminated with the heat-sealable plastic material, there may be used a film of oxygen-absorbing resin, or a laminated film made of oxygen-absorbing resin and other thermoplastic resin.

As the oxygen-absorbing resin, there may be used (1) resin that in itself has an oxygen-absorbing capability, or (2) a resin composition containing an oxygen absorbent in thermoplastic resin that has or does not have an oxygen-absorbing capability. There is no particular limitation on the thermoplastic resin forming the oxygen-absorbing resin composition mentioned in item (2) above; either thermoplastic resin having an oxygen barrier capability or thermoplastic resin having no oxygen barrier capability. Using the resin, which itself has an oxygen-absorbing capability or oxygen barrier capability, as the thermoplastic resin forming the resin composition mentioned in item (2) above is preferable in that entry of oxygen into a container can be effectively prevented by a combination with the oxygen-absorbing effect provided by the oxygen absorbent.

Among examples of the resin that in itself has an oxygen-absorbing capability is one that takes advantage of oxidization reaction of the resin. For example, there may be used resin that is formed by adding organic salt containing, as an oxidization catalyst, transition metal, like cobalt, rhodium or copper, or photosensitizer to an oxidizing organic material, such as polybutadiene, polyisoprene, polyprorylene, ethylene-carbon monoxide copolymer, nylon-6, nylon-12 or m-xylylenediamine nylon (MX). In the case where such an oxygen absorbent is used, further advantageous results can be achieved by irradiating high-energy rays, such as ultraviolet rays or electronic rays.

Any one of the oxygen absorbents conventionally employed in this type of application may be used as the oxygen absorbent contained in the thermoplastic resin; however, in general, an oxygen absorbent, which has a reducing capability and substantially insoluble in water. As a suitable example, there may be used an oxygen absorbent in the form of metal powder having a reducing capability, which for example includes, as a primary component, any one of, or a combination of two or more, of reducing iron, reducing zinc and reducing tin; low-order metallic oxide, such as FeO or $Fe_3O_4$; and a reducing metallic compound, such as iron carbide, ferro silicon, iron carbonyl or iron hydroxide. Among particularly preferable examples of the oxygen absorbent is reducing iron, such as: one formed by reducing oxidized iron, obtained for example during production of steel, with coke to thereby produce sponge iron, then crushing the sponge iron, and thence finish-reducing the crushed sponge iron in hydrogen gas or dissociated ammonia gas; or one formed by electrolytic decomposition of iron from aqueous iron chloride obtained during acid cleaning, then crushing the iron and thence reducing the crushed iron.

As necessary, the oxygen absorbent may be used in combination with a pro-oxidant, such as a hydroxide of alkali metal or alkaline earth metal or an electrolyte of carbonate, sulfite, thiosulfate, triphosphate, diphosphate, organic acid salt, halide or the like, and/or with an assistant, such as activated carbon, activated alumina or white clay. Among particularly preferable examples of the pro-oxidant are sodium chloride, calcium chloride or a combination of sodium chloride and calcium chloride.

In the case where reducing iron and pro-oxidant are used in combination, the combination ratio is preferably set, assuming the total amount to be 100 part by weight, such that the reducing iron is in an amount of 99-80 part by weight while the pro-oxidant is in an amount of 1-20 part by weight; especially, it is preferable that the reducing iron be in an amount of 98-90 part by weight and the pro-oxidant be in an amount of 2-10 part by weight.

Among examples of the other oxidant absorbent is a high molecular compound having a polyhydric phenol within a skeleton, such as polyhydric phenol-contained phenol-aldehyde resin. Further, any one of erythorbic acid, erythorbic acid, tocopherol, which are water-soluble substances, and salts of these substances may be suitably used. Of these oxidant-absorbing substances, the reducing iron and ascorbic acid-series compound are the most preferable.

Further, the above-mentioned resin that in itself has an oxygen-absorbing capability may be contained, as an oxygen absorbent, in the thermoplastic resin.

It is generally preferable that each of the above-mentioned oxygen absorbents have an average grain diameter of 50 μm or less, particularly 30 μm or less. If transparency or translucency is required, it is preferable that each of the above-mentioned oxygen absorbents have an average grain diameter of 10 μm or less, particularly 5 μm or less. It is preferable that the oxygen absorbent be contained in the resin in an amount of 1-70 percent by weight, particularly 5-30 percent by weight.

In the present invention, a packaging bag designed for heating by a microwave oven is made by heat-sealing an unstretched (unoriented) or uniaxially- or biaxially-stretched film, formed of the above-mentioned plastic material, in the conventional manner. If the film is a laminated film formed by heat-sealable thermoplastic resin and nonheat-sealable thermoplastic resin, the film is heat-sealed in such a manner that a layer of the heat-sealable thermoplastic resin forms the reverse surface of the bag.

Next, a description will be given about a construction of the flat-type plastic pouch of the present invention, with reference to the drawings, although specific examples to be described below are in no way intended to limit the present invention.

Figure 2:
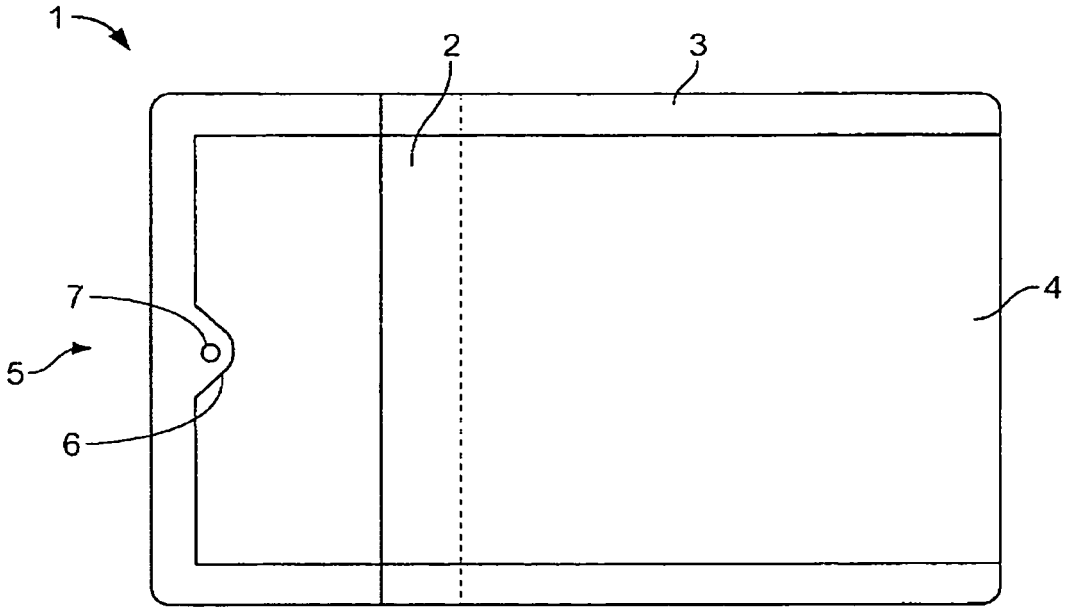
FIG. 2 is a view of the plastic pouch, manufactured through the steps of FIG. 1, taken from the back side of the pouch.
Figure 3A:
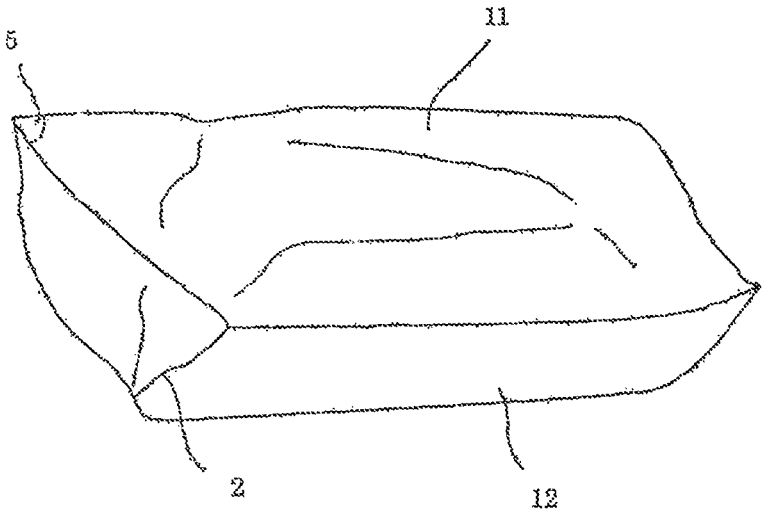
FIG. 3 is a schematic view showing the plastic pouch of FIG. 2 heated within a microwave oven.
Figure 3B:
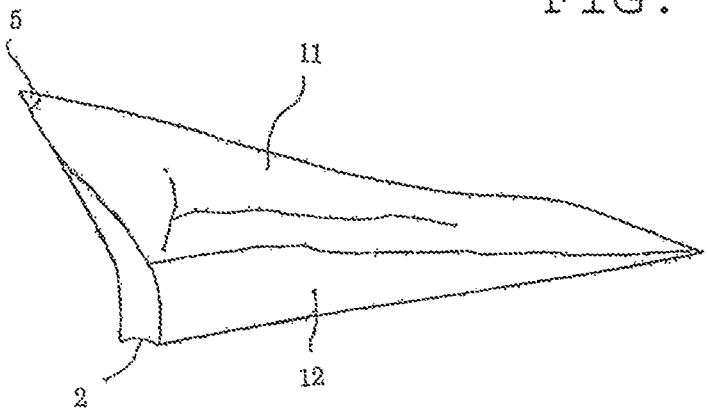

FIGS. 1-3 show an embodiment of the plastic pouch of the present invention, where FIG. 1 is a schematic view explanatory of steps for manufacturing the pouch and FIG. 2 is a view of the pouch as taken from the back side of the pouch.

FIG. 3 is a schematic view showing the pouch of the present invention heated in a microwave oven; more specifically, (a) shows the pouch being heated for cooking in an unopened state, while (b) shows the pouch having been completely heated for cooking in a partly-opened state.

The pouch 1 of the present invention is made by superposing a film 11 constituting the obverse surface of the pouch to be manufactured and another film 12 constituting the reverse surface of the pouch to be manufactured upon each other and heat-sealing together respective peripheral edge portions of the two films 11 and 12. At that time, the film 12 constituting the reverse surface of the pouch is folded back in a Z configuration across the entire width of the pouch and the respective peripheral edge portions of the two films 11 and 12 are heat-sealed together except for respective one end portions (at the narrow side of the films) that form a filling opening 4 for filling the pouch with desired contents, so as to form a folded-back section 2 communicating with the body of the pouch. On the other narrow-side end portion, opposite from the filling opening 4, a vapor-evacuating seal section, having a weakened portion, is formed by projecting a peripheral-edge seal portion toward the interior of the pouch in a U shape and then forming an opening (e.g., through-hole) portion 7 in the projected portion 6. In this manner, an automatic opening mechanism 5 is provided which automatically opens as the pouch is heated by the microwave oven.

The weakened portion of the vapor-evacuating seal section may of course be formed using any one of the other known methods, such as one that forms a half-through-hole, slit or unsealed portion instead of the through-hole.

After the desired contents, such as food, have been packed into the pouch 1, the filling opening 4 is hermetically heat-sealed, and the pouch is subjected to a retort sterilizing process and then laid horizontally flat within the microwave oven. Then, as the pouch is heated for cooking, the interior pressure of the pouch increases due to vapor etc. produced from the contents, so that the pouch swells. During that time, the vapor also goes into the folded-back section 2 provided on the reverse surface of the pouch 12, so that the pouch end portion, where the automatic opening mechanism 5 is provided, is caused to rise upward starting at the folded-back section 2 (see (a) of FIG. 3).

As the interior pressure of the pouch increases, a stress concentrates at the distal end of the projection 6 of the automatic opening mechanism 5, which causes the sealed portion gradually peels outwardly away from the body of the pouch. Once the peeling of the sealed portion has reached the opening 7, the pouch has been brought to a partly-opened position, so that the vapor etc. are discharged out of the pouch through the opening 7 and thus the interior pressure falls. During that time too, the folded-back section 2 functions like a stand, so that the automatic opening mechanism 5 currently in the opened position can be stably held at a high position (see (b) of FIG. 3).

Thus, even during the heating for cooking or after completion of the heating for cooking by the microwave oven, the automatic opening mechanism 5 provided on the pouch 1 can be held at a high position, and thus the pouch 1 can prevent blowout or leakage of the contents.

Figure 4:
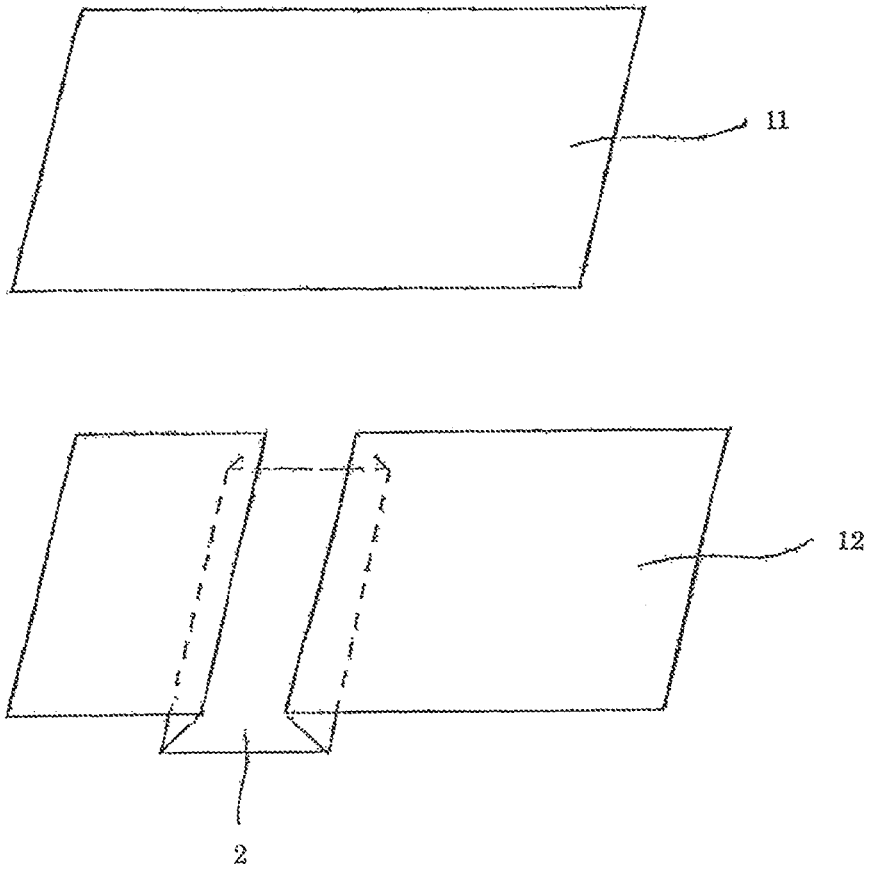
FIG. 4 is a schematic view explanatory of steps for manufacturing another embodiment of a plastic pouch of the present invention.
Figure 5:
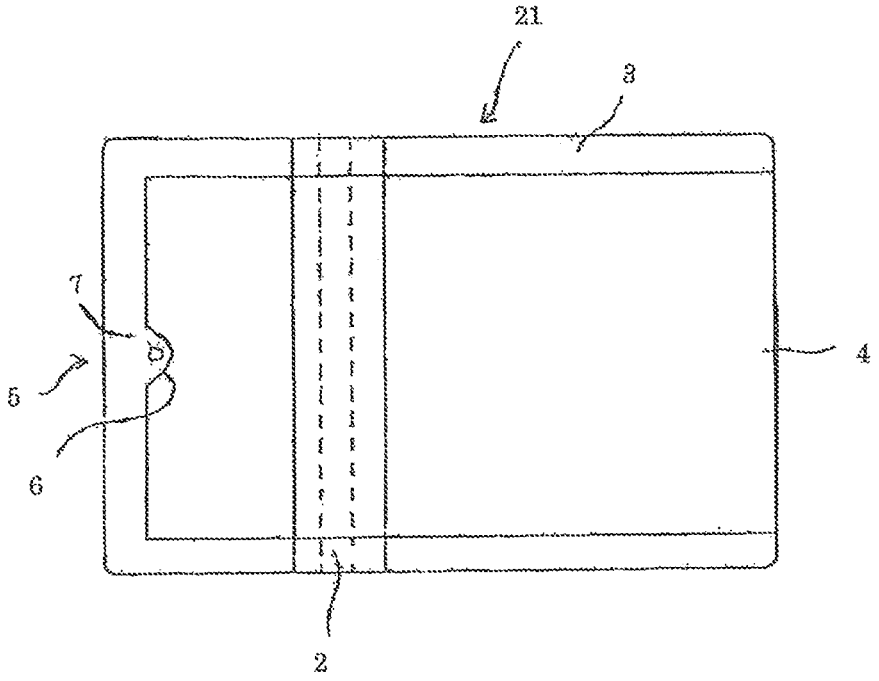
FIG. 5 is a view of the plastic pouch, manufactured through the steps of FIG. 4, taken from the back side of the pouch.

FIGS. 4 and 5 show another embodiment of the plastic pouch of the present invention, where FIG. 4 is a schematic view explanatory of steps for manufacturing the pouch and FIG. 5 is a view of the pouch as taken from the back side of the pouch.

In this pouch 21, the film 12 constituting the reverse surface of the pouch is folded back in a Z configuration across the entire width of the pouch and then further folded back in a reverse Z configuration, to thereby form a folded-back section 2. Further, an automatic opening mechanism 5 is formed by projecting a peripheral-edge seal portion toward the interior of the pouch in a U shape and then forming an opening portion 7 in the projected portion 6. Other arrangements of the pouch 21 are similar to those of the pouch 1 having been described above in relation to FIGS. 1-3.

Because the film 12 is folded back at opposite ends of the folded-back section 2, the folded-back section 2, expanded by entry thereinto of vapor as the pouch 21 is heated for cooking by the microwave oven, assumes an increased cubic capacity. Thus, the rising of the end portion of the pouch 21, starting at the folded-back section 2, is considerably facilitated, which therefore allows the automatic opening mechanism 5 to be stably held at a higher position.

Figure 6:
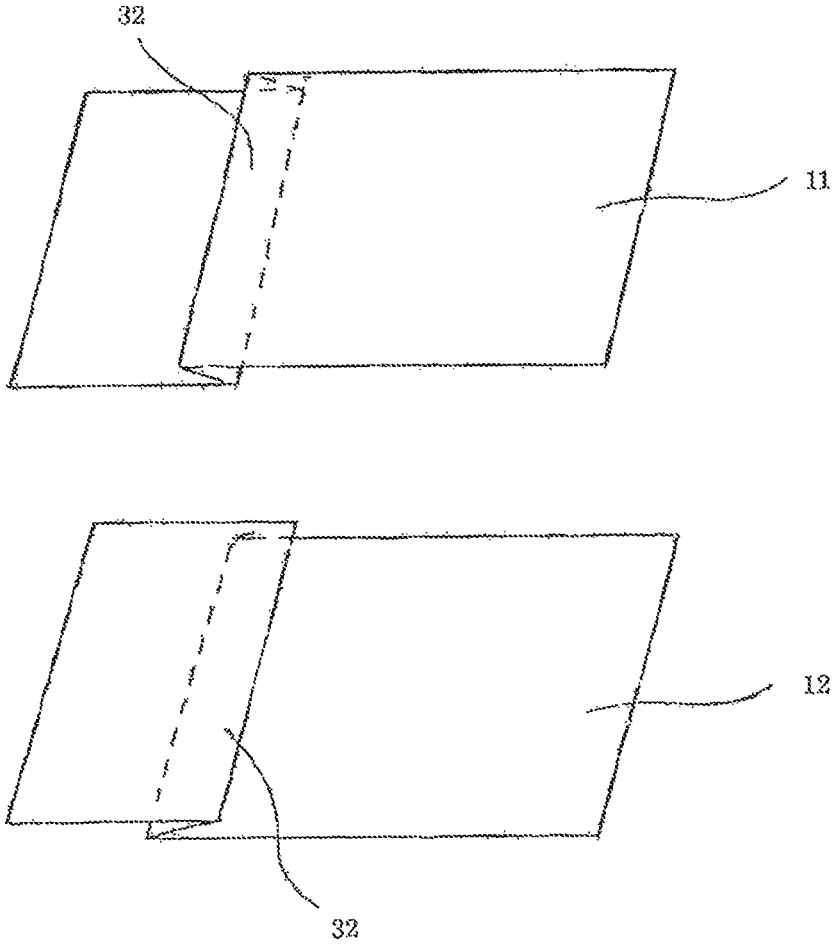
FIG. 6 is a schematic view explanatory of steps for manufacturing still another embodiment of a plastic pouch of the present invention.
Figure 7:
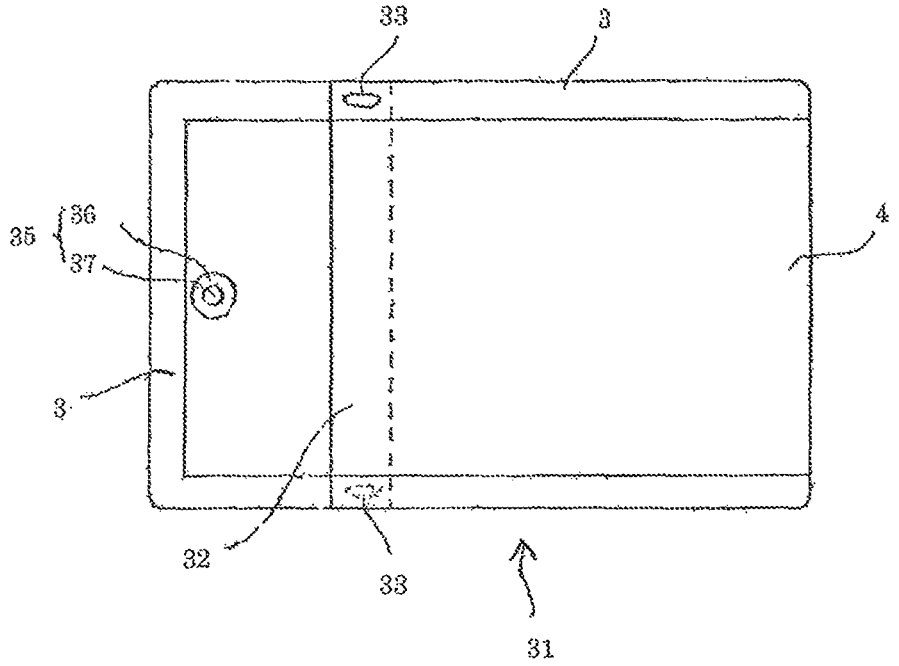
FIG. 7 is a view of the plastic pouch, manufactured through the steps of FIG. 6, taken from the front side of the pouch.
Figure 8:
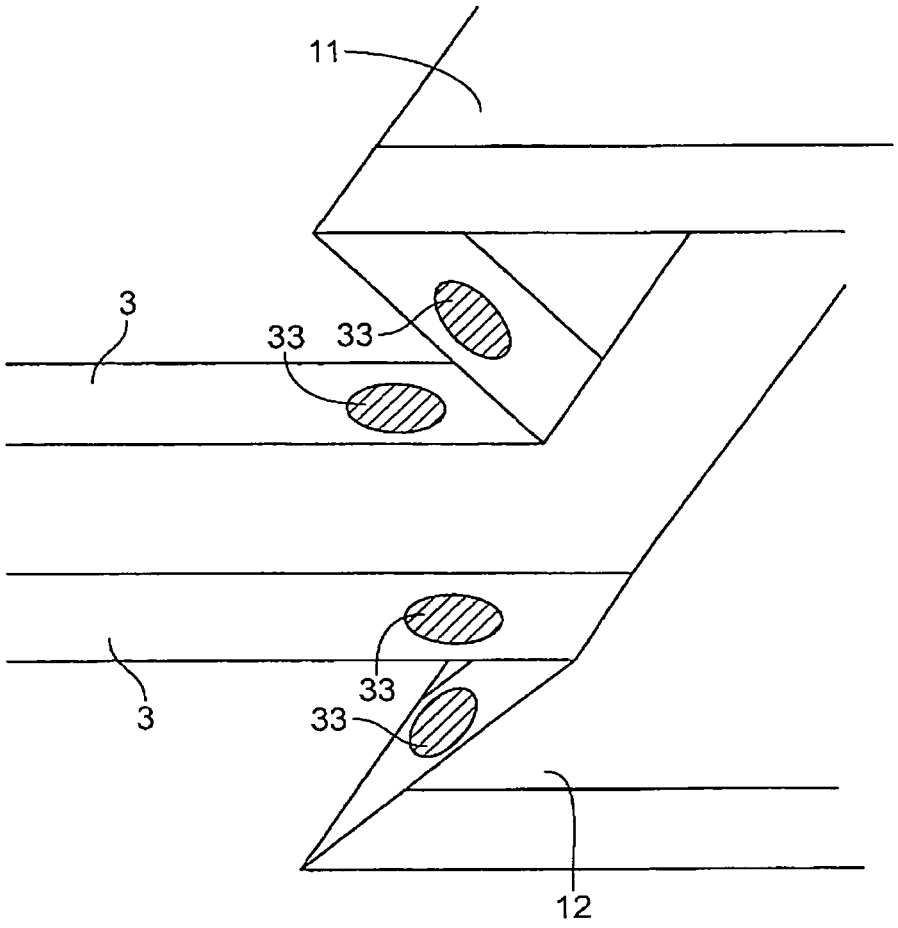
FIG. 8 is a schematic view explanatory of steps for forming a folded-back section of the pouch shown in FIG. 7.

FIGS. 6-8 show still another embodiment of the plastic pouch of the present invention, where FIG. 6 is a schematic view explanatory of steps for manufacturing the pouch, FIG. 7 is a view of the pouch as taken from the front side of the pouch and FIG. 8 is an enlarged schematic view explanatory of steps for forming a folded-back section of the pouch.

In this pouch 31, folded-back sections 32 are provided on both surfaces of the pouch, by folding back both the film 11 constituting the obverse surface of the pouch and the film 12 constituting the obverse surface of the pouch at same (i.e., corresponding) positions in a reverse Z configuration and Z configuration, respectively.

In forming the folded-back sections 32, holes 33 are formed in portions of the front-side film 11 and back-side film 12 constituting peripheral seal portions 3; more specifically, the holes 33 are formed in layers of the films 11 and 12 located inwardly of the respective outmost film layers (in this case, a total of four holes 33 are formed), as seen in FIG. 8. Then, the outmost film layers of the films 11 and 12 are heat-sealed together through the holes 33.

By arranging such heat-sealing in the folded-back sections 32, the peripheral seal portions 3 of the folded-back sections 32 can have enhanced heat-sealing intensity, which allows the one end portion of the pouch to rise upward with increased reliability as the pouch 31 is heated for cooking by the microwave oven.

The above-described arrangements of forming the holes 33 in the inner film layers of the peripheral seal portions 3 of the folded-back sections 32 may also be applied to the pouches of FIGS. 1-5 where the folded-back section is formed only on the reverse surface film of the pouch.

Further, as an automatic opening mechanism 35 in the pouch 31, a vapor-evacuating seal section 36 having a weakened portion 37 is formed by heat-sealing together the obverse and reverse surface films at a position separate from the peripheral seal portions 3 and then forming an opening (e.g., through-hole) 37 in the resultant heat-sealed portion 36.

The weakened portion 37 may of course be formed using any one of the other known methods, such as one that forms a half-through-hole, slit or unsealed portion instead of the through-hole.

Figure 9:
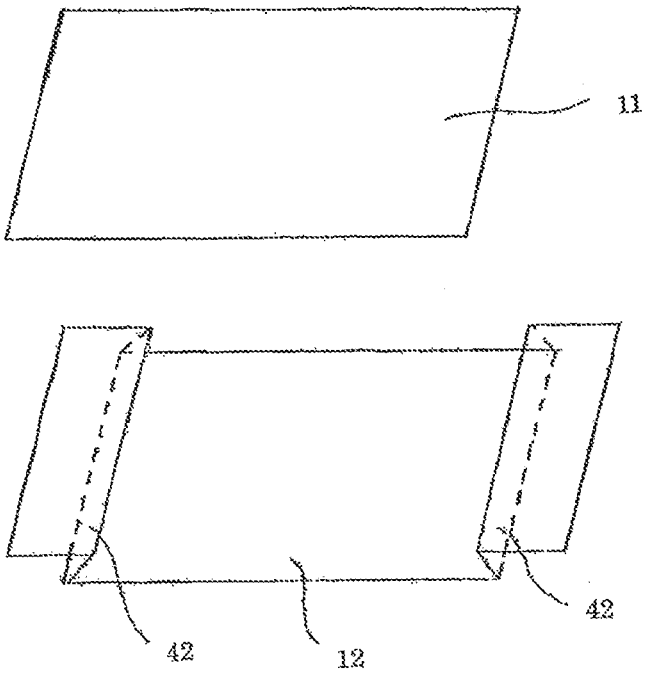
FIG. 9 is a schematic view explanatory of steps for manufacturing still another embodiment of a plastic pouch of the present invention.
Figure 10:
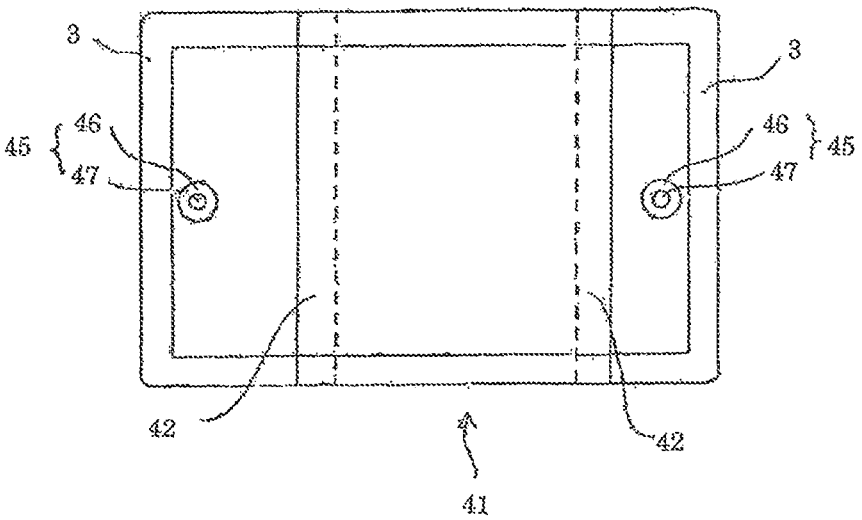
FIG. 10 is a view of the plastic pouch, manufactured through the steps of FIG. 9, taken from the back side of the pouch.
Figure 11:
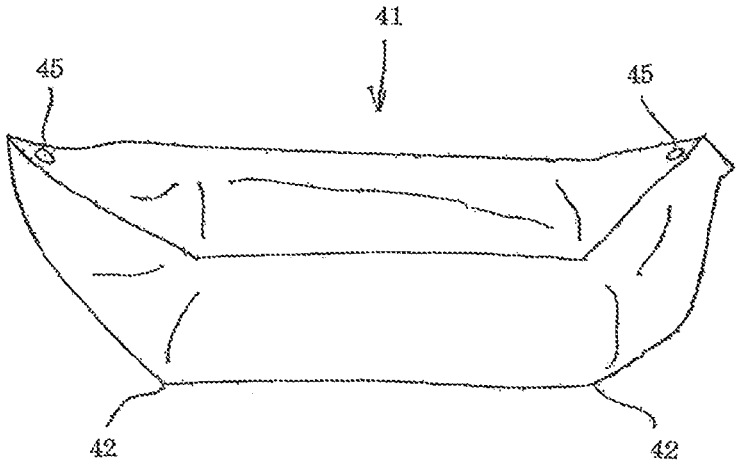
FIG. 11 is a schematic view showing the plastic pouch of FIG. 10 heated within a microwave oven.

FIGS. 9-11 show still another embodiment of the plastic pouch of the present invention, where FIG. 9 is a schematic view explanatory of steps for manufacturing the pouch, FIG. 10 is a plan view of the pouch as taken from the back side of the pouch and FIG. 11 is a schematic view showing the pouch having been heated for cooking within a microwave oven.

In the pouch 41, the film 12 constituting the reverse surface of the pouch is folded back in a Z configuration across the entire width of the pouch at a position adjacent to one end of the pouch to thereby provide a first folded-back section 42, and the film 12 is also folded back in a reverse Z configuration at a position adjacent to the other end of the pouch to thereby provide a second folded-back section 42.

At the opposite end portions of the pouch 41, there are provided automatic opening mechanisms 45 by forming vapor-evacuating seal sections 46, each having a weakened portion 47 in the form of an opening, at positions separate from the peripheral seal portions 3.

As the pouch 41 is laid horizontally flat in the microwave oven and heated for cooking, the interior pressure of the pouch 41 increases due to vapor etc. produced from the contents, so that the pouch 41 swells. During that time, the vapor also goes into the folded-back sections 42, so that the opposite pouch end portions rise upward starting at the corresponding folded-back sections 42 and thus the automatic opening mechanisms 5 are each held at a high position (see FIG. 11). Even after completion of the heating for cooking, when the interior pressure of the pouch 41 has fallen with each of the automatic opening mechanisms 5 brought into an opened position, the pouch 41 keeps substantially the same shape in a shrunken state, and thus, the pouch 41 can be used like a tray.

Whereas each of the embodiments of the present invention has been described above in relation to the case where one or two automatic opening mechanisms are provided, the plastic pouch of the present invention, having one or more folded-back sections, may be constructed with no such automatic opening mechanism provided.

There is no particular limitation on the automatic opening mechanism employed in the present invention. For example, the automatic opening mechanism may be provided by projecting the peripheral-edge seal portion into the interior of the pouch in a U or V shape, forming, in the projected portion, an unsealed portion communicating with the outside of the pouch or punching such an unsealed portion. Further, the automatic opening mechanism may comprise any conventionally-known means other than the above-described vapor-evacuating seal section; for example, the automatic opening mechanism may be provided using a member separate from the plastic pouch.

Furthermore, needless to say, the plastic pouch of the present invention may be of any suitable size and shape, and the films forming the pouch may be of any suitable materials.

Moreover, the contents to be packed in the plastic pouch of the present invention may be any type of food to be cooked by a microwave oven prior to use, such as not only food requiring a retort-sterilizing process, but also frozen food requiring no retort-sterilizing process.

The following paragraphs describe embodiments of methods for manufacturing a plastic pouch according to the present invention.

Figure 12:
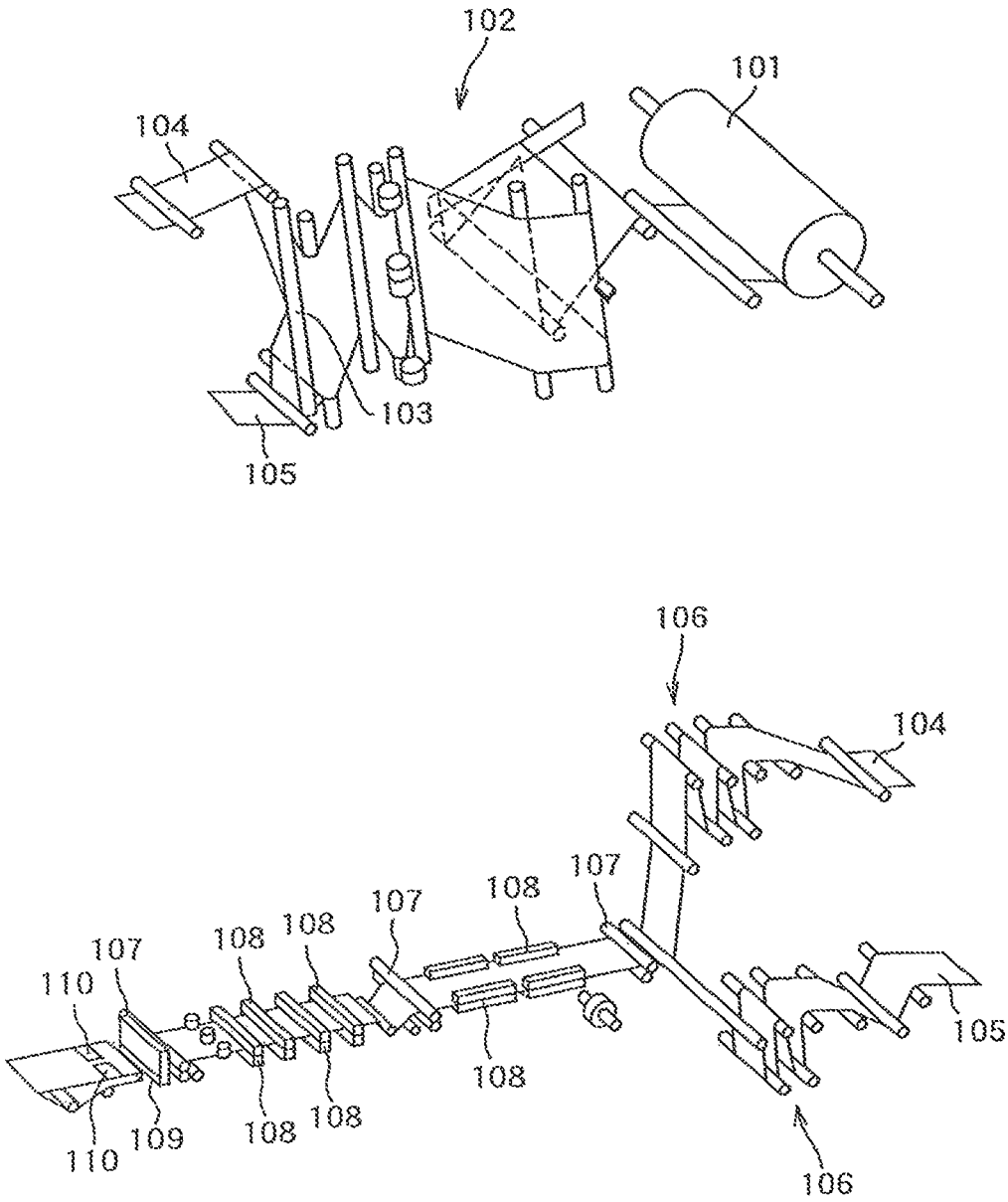
FIG. 12 is a schematic view showing an ordinary manufacturing line for manufacturing a conventional flat-type pouch.
Figure 13A:
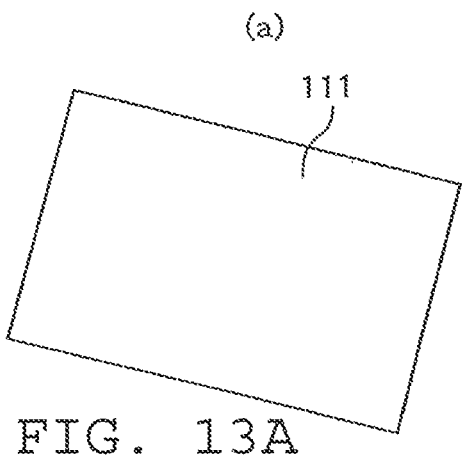
FIG. 13 shows a plastic pouch to be manufactured in accordance with the present invention, where (a) is a perspective view of an obverse surface member, (b) is a perspective view of a reverse surface member, (c) is a bottom view of the pouch in an assembled state and (d) is a perspective view of the pouch in a heated condition.
Figure 13B:
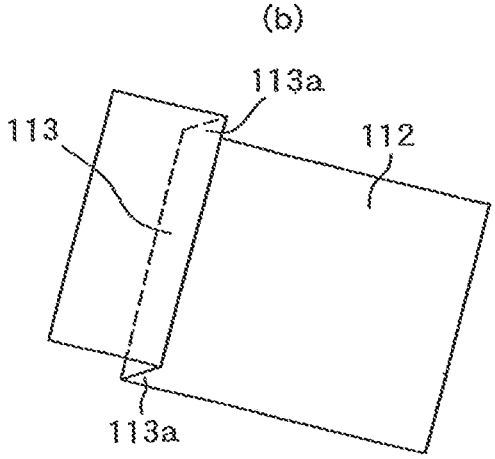
Figure 13C:
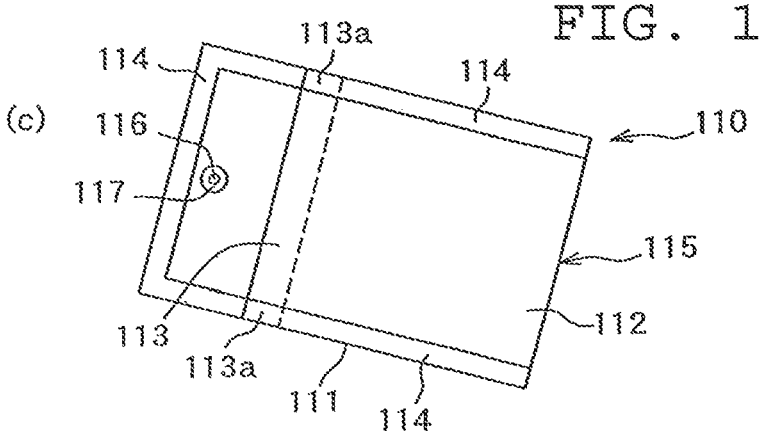
Figure 13D:
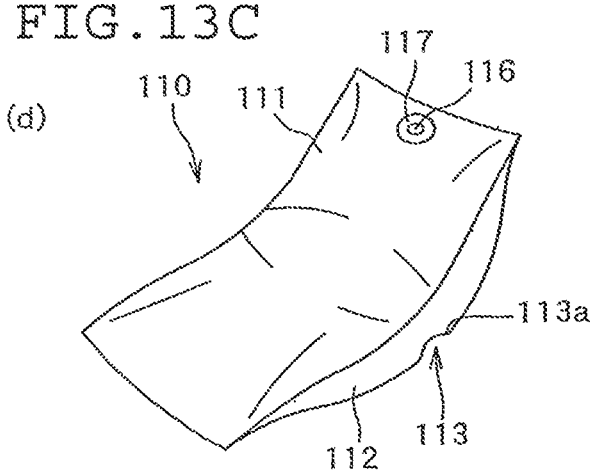

First, an ordinary manufacturing line for manufacturing a conventional flat-type pouch will be explained in relation to a two-row manufacture scheme shown in FIG. 12 where two pouches are manufactured at a time. In FIG. 12, a pouch material 101, in the form of a roll of plastic film laminate having a thermal adhesive (heat bonding) capability at least in its inner surface, is fed out via an unrolling mechanism 102 that unrolls the pouch material 101 from a horizontal rolled position to a vertical unrolled position. Then, the unrolled pouch material 101 is severed via a laser slitter 103, after which it is fed horizontally while being divided into a pair of upper and lower films 104 and 105 whose opposed surfaces have a thermal adhesive capability.

These two films 104 and 105 are delivered via intermittently-feeding dancing rollers 106, then further fed via a feed roller 107 and thence superposed on each other through a printing-based positioning operation. After that, the superposed films 104 and 105 are heat-sealed together at their portions that will form a bottom portion and opposite side portions of the pouch, and then cut via a cutter unit 109 into each individual pouch. In this way, two rows of pouches can be manufactured simultaneously.

The following paragraphs describe a plastic pouch to be manufactured by the above-described manufacturing line, with reference to FIG. 13.

In FIG. 13 showing the plastic pouch, (a) is a perspective view of an obverse surface member, (b) is a perspective view of a reverse surface member, (c) is a bottom view of a pouch in an assembled state and (d) is a perspective view of the pouch heated by a microwave oven.

The plastic pouch 110, as illustratively shown in FIG. 13, generally comprises the obverse surface member 111 and reverse surface member 112, and a folded-back section 113 is provided on an intermediate portion of the reverse surface member 112 across the width of the reverse surface member 112. Specifically, the folded-back section 113 is formed by folding back the reverse surface member 112, along a line extending widthwise (in a longitudinally-intermediate area of the reverse surface member 112) at right angles to opposite side edges of the member 112, and peripheral edge portions of the surface members 111 and 112 are heat-sealed together along their peripheral edges to provide sealed portions 114. Before the pouch is filled with contents, one side of the pouch, which will become the bottom of the pouch, is left unsealed to provide a filling opening 115.

Further, in the pouch 110 of FIG. 13, opposite widthwise ends 113*a* of the folded-back section 113, located outwardly of the sealed portions 114, are fixed to the reverse surface member 112.

In a case where contents that have to be heated by a microwave oven are to be packed into the pouch, for example, an opening 116 that automatically opens in response to an increase in the interior pressure of the pouch is formed, as necessary, as a through-hole passing through a heat-seal portion 117. For example, the heat-seal portion 117 is formed separately from the peripheral-edge sealed portion 114 of the pouch, and the opening 116 is formed in this heat-seal portion 117.

Namely, in the pouch 110, where the folded-back section 113 communicating with the interior of the pouch is provided widthwise on an intermediate portion of the one surface member 112 of the flat-type pouch. Thus, as the folded-back section 113 is swollen by the increased interior pressure of the pouch, the surface member 112, extending widthwise at right angles to the opposite sides, can have an increased length and thus can easily rise upward. As a result, the automatic opening portion 116 can be held at a high position (see (d) of FIG. 13).

In manufacturing the pouch 110 which has such a folded-back section 113 with its outer ends 113*a* fixed to the surface member 112, the ways of forming the folded-back section 113 and fixing the opposite ends 113*a* of the folded-back section 113 have great influences on the overall production efficiency.

Figure 14:
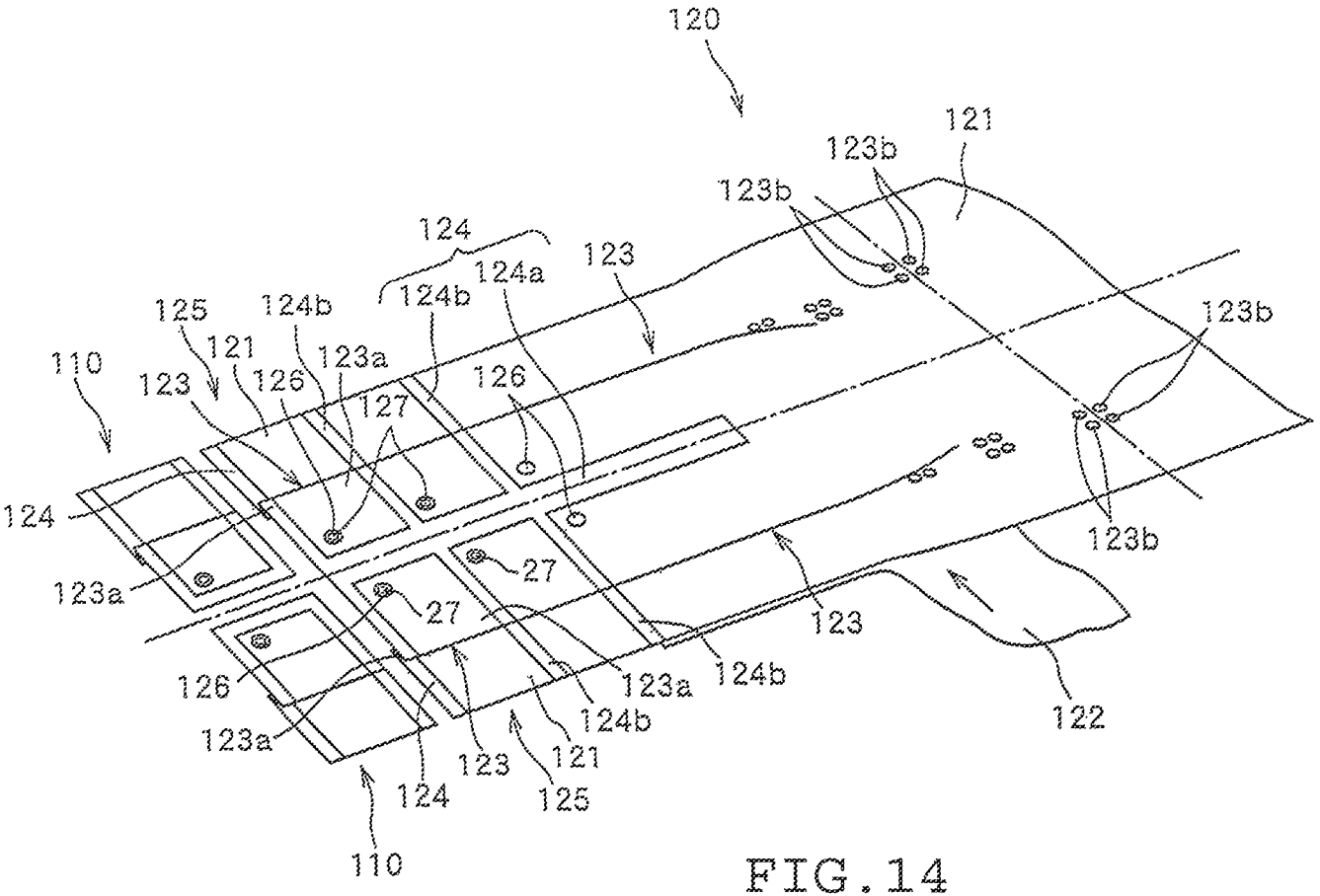
FIG. 14 is a schematic view explanatory of steps of a plastic pouch manufacturing method in accordance with an embodiment of the present invention.

Thus, according to the plastic pouch manufacturing method 120 of the present invention, as shown in FIG. 14, a portion of the obverse surface member 121 is folded to provide a folded-back section 123. Where the method of the invention is applied to the two-row manufacturing line where two pouches are made simultaneously, the two pouches are made in a side-by-side relation to each other on the obverse and reverse surface members 121 and 122 with their top portions opposed to each other and their bottom portions facing outwardly away from each other.

According to the manufacturing method 120, a plastic film laminate, whose inner surface has a thermal adhesive capability, is severed and fed in such a manner that respective inner surfaces of the resultant two divided film members are opposed to each other, to provide obverse and reverse surface members 121 and 122, by means of a manufacturing line like that already explained above in relation to FIG. 12. Then, holes 123*b* are formed for fixing together, through heat-sealing, the opposite ends 123*a* of the folded-back section 123.

Figure 15A:
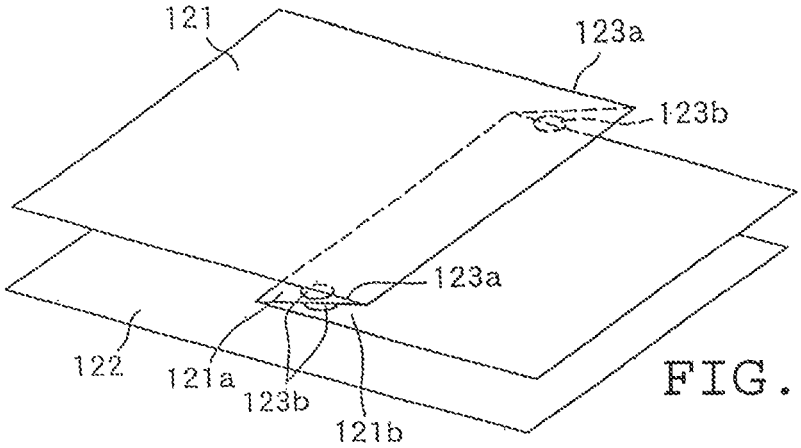
FIG. 15 is a schematic view explanatory of positions of holes for fixing a folded-back section according to the embodiment of the plastic pouch manufacturing method.
Figure 15B:
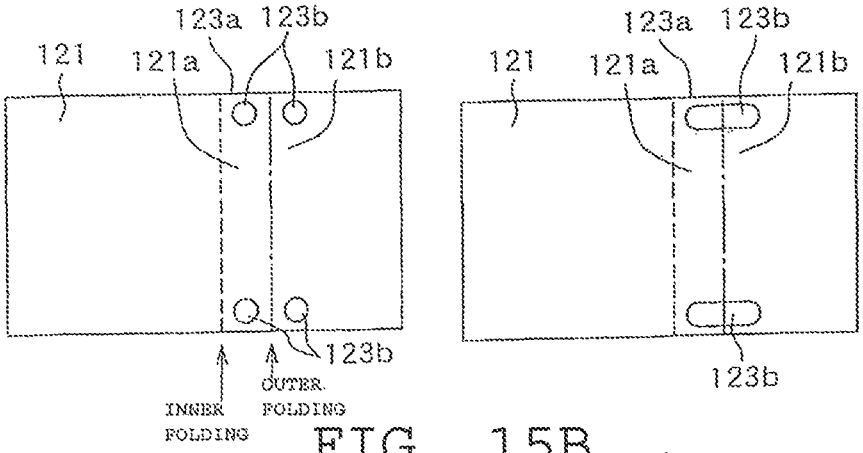
Figure 15C:
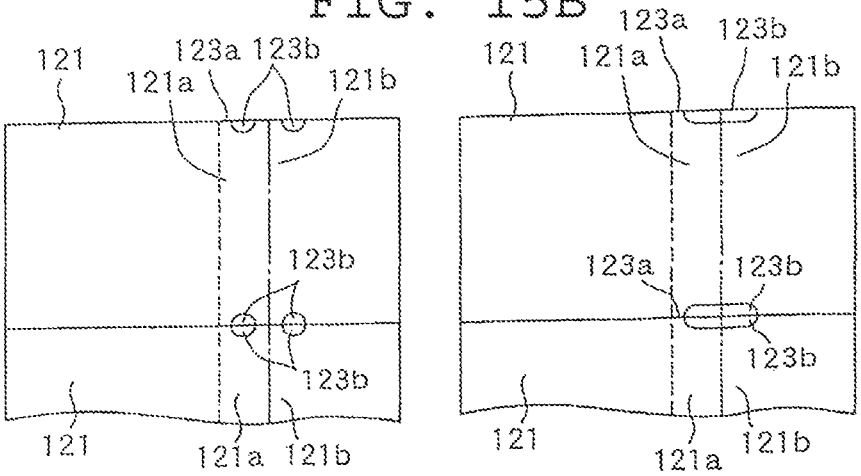

As shown in (a) of FIG. 15, the hole formation for fixing, through heat-sealing, the opposite ends 123*a* of the folded-back section 123 may be effected by forming the holes 123*b* in two inner surface member portions 121*a* and 121*b* folded to be sandwiched between the outermost portions of the obverse and reverse surface members 211 and 122 and hence located inwardly of the obverse surface member 121. Thus, the opposite ends 123*a* of the folded-back section 123 can be fixed by the obverse and reverse surface members 121 and 122 being heat-sealed together, through the holes 123*b*, in direct contact with each other.

As illustrated in (b) of FIG. 15, the holes 123*b* for fixing, through heat-sealing, the opposite ends 123*a* of the folded-back section 123 may be circular holes formed in the two surface member portions 121*a* and 121*b*, or oval holes 123 each continuously formed to extend over both of the surface member portions 121*a* and 121*b*.

Alternatively, each of the holes 123*b* may be formed to extend over a pair of pouches manufactured in succession (one after another) on the manufacturing line so that semi-circular or semi-oval holes 123*b* are formed in each of the successive pouched, as illustrated in (c) of FIG. 15. In this case, the number of hole-forming machines to be installed can be reduced by half.

Then, the obverse surface member 121 are folded along two separate lines thereof to thereby form two separate folded-back sections 123, after which longitudinal and transverse sealing 124*a* and 124*b* is performed on peripheral edge portions of the pouch with a filling opening 125 left unsealed and the ends 123*a* of each of the folded-back sections 123 are also fixed, through the holes 123*b*, by the transverse sealing 124*b*.

Further, during the heat-sealing of the peripheral edge portions of the pouch, heat-sealing 126 for forming an automatic opening portion is performed simultaneously with one of the longitudinal and transverse heat-sealing 124*a* and 124*b* which takes place closer to the automatic opening portion.

Figures 16A, 16B:
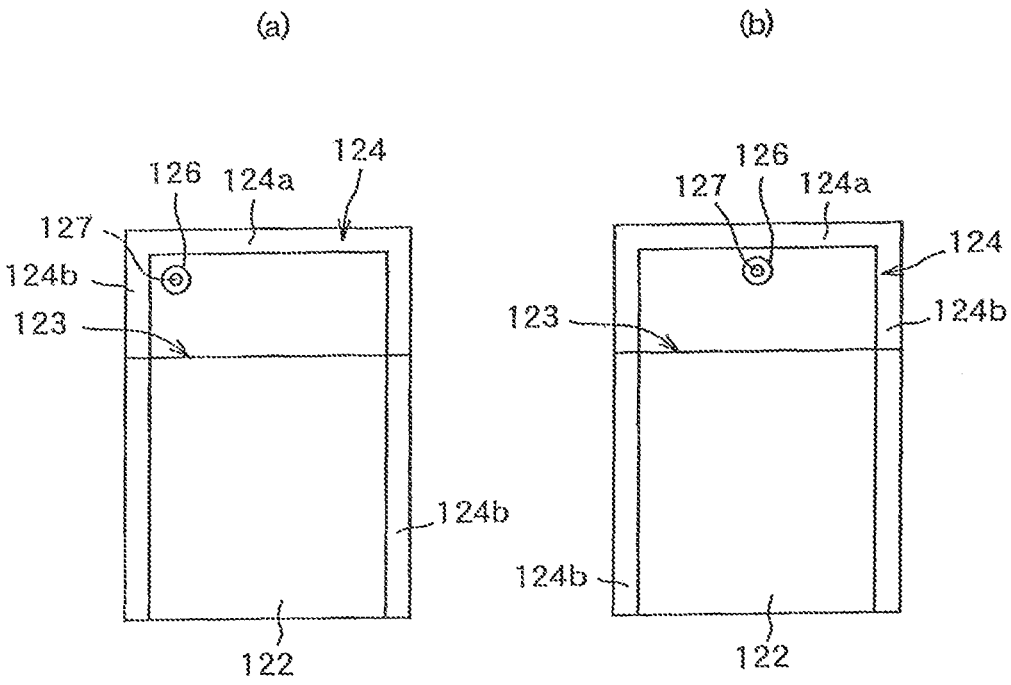
FIG. 16 is a schematic view explanatory of a position of an automatic opening portion according to the embodiment of the plastic pouch manufacturing method.
Figure 17:
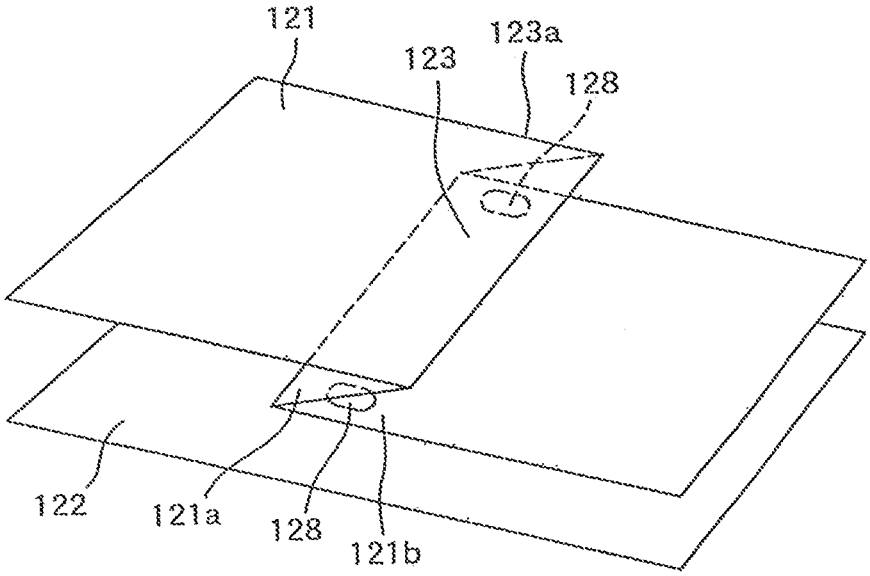
FIG. 17 is a schematic view explanatory of another way of fixing the folded-back section according to the embodiment of the plastic pouch manufacturing method.

Namely, if the heat-sealing 126 for forming the automatic opening portion 127 is to be performed at a corner portion between the longitudinal and transverse heat-sealing 124*a* and 124*b* as illustrated in (a) of FIG. 16, then the heat-sealing 126 may be performed during any one of the longitudinal and transverse heat-sealing 124*a* and 124*b*. If the heat-sealing 126 for forming the automatic opening portion 127 is to be performed adjacent to a middle portion of the longitudinal heat-sealing 124*a* as illustrated in (b) of FIG. 16, then the heat-sealing 126 may be performed during the longitudinal heat-sealing 124*a*.

Then, a hole-forming operation is performed on the heat-sealed portion that has been formed by the heat-sealing 126 for forming the automatic opening portion 127.

After that, the heat-sealed obverse and reverse surface members 121 and 122 are cut via a cutter unit into each individual pouch. In this way, two pouches can be manufactured simultaneously.

Namely, according to the plastic pouch manufacturing method 120 described above, a plastic pouch is manufactured by forming one widthwise folded-back section 123 on the obverse surface member 121 in communication with the interior of the pouch, heat-sealing together peripheral edge portions of the surface members and fixing the widthwise opposite ends 123*a* of the folded-back section 123, located outwardly of the sealed portions, to the obverse surface member 121. Because the folded-back section 123 is formed by folding a portion of the obverse surface member 121, it is possible to readily form the folded-back section 123 on the obverse surface member 121 in the form of a web fed both continuously and intermittently.

Thus, the method of the present invention can readily manufacture plastic pouches, each having a folded-back section 123, in the two-row manufacturing fashion.

Note that the aforementioned step of forming the holes 123*b* for fixing the opposite ends of the folded-back section 123 may be performed by rotary die cutting during continuous feeding of the obverse and reverse surface members 121 and 122 or performed by a punch mechanism during intermittent feeding of the obverse and reverse surface members 121 and 122.

Further, folding of a portion of the obverse surface member 121 for the formation of the folded-back section 123 may be performed during continuous feeding of the obverse surface member 121 or after an intermittent feeding condition has been created via dancing rollers or the like. It is more preferable to fold the portion of the obverse surface member 121 during continuous feeding of the obverse surface member 121 in that stability of the folding step can be secured.

In the case where there is provided the step of forming the holes 123*b* for fixing the opposite ends 123*a* of the folded-back section 123 and holes are formed in two obverse surface member portions 121, interposed between the folded-back sections 123, for fixation by heat-sealing (as in the case shown in FIG. 14), it is preferable to fold the obverse surface member 121 after the intermittent feeding condition has been created, because, in this case, the intermittently feeding condition can be utilized efficiently and thus efficient manufacturing is permitted.

Fixation of the opposite ends 123*a* of the folded-back section 123 need not necessarily be performed simultaneously with the heating-sealing 124 of the peripheral edge portions following the formation of the holes 123*b*. For example, the opposite ends 123*a* of the folded-back section 123 may be fixed by an adhesive 128, such as a hot-melt adhesive, by a mechanical fixation means, such as a stapler or rivet, by welding based on supersonic sealing, or by any other suitable fixation method.

The preferred embodiment has been described above as forming the folded-back sections 123 on two separate positions of the obverse surface member 121 in the case where it is applied to the two-row manufacturing line. In an alternative, the reverse surface member 121 may be folded at two portions thereof to form two folded-back sections 123 thereon, or one folded-back section 123 may be formed on each of the obverse and reverse surface members 121 and 122.

The two rows of folded-back sections 123 may be oriented either in symmetrical relation to each other, or in asymmetrical relation to each other.

Further, in the case where two rows of folded-back sections 123 are formed in the two-row manufacturing line, the two rows need not necessarily be formed simultaneously and may be formed at differentiated timing (one after another) as long as formation of the two rows of folded-back sections 123 is completed before the heat-sealing 124 is performed.

Further, in a single-row manufacturing line, a portion of any one of the obverse and reverse surface members 121 and 122 may be folded to provide folded-back sections 123, and plastic pouches can be manufactured through manufacturing steps similar to those in the two-row manufacturing line.

Next, a description will be given about another embodiment of the plastic pouch manufacturing method, with reference to FIGS. 18 and 19, where the same elements as in the above-described embodiment are indicated by the same reference characters and will not be described to avoid unnecessary duplication.

Figure 18A:
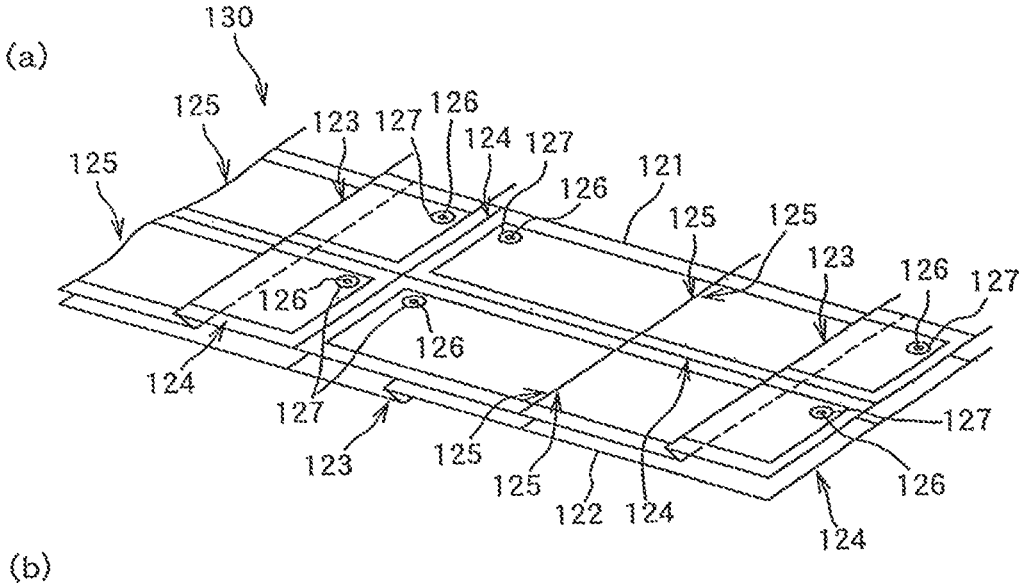
FIG. 18 is a schematic view explanatory of a plastic pouch manufacturing method in accordance with another embodiment of the present invention, where (a) and (b) show steps of the method.
Figure 18B:
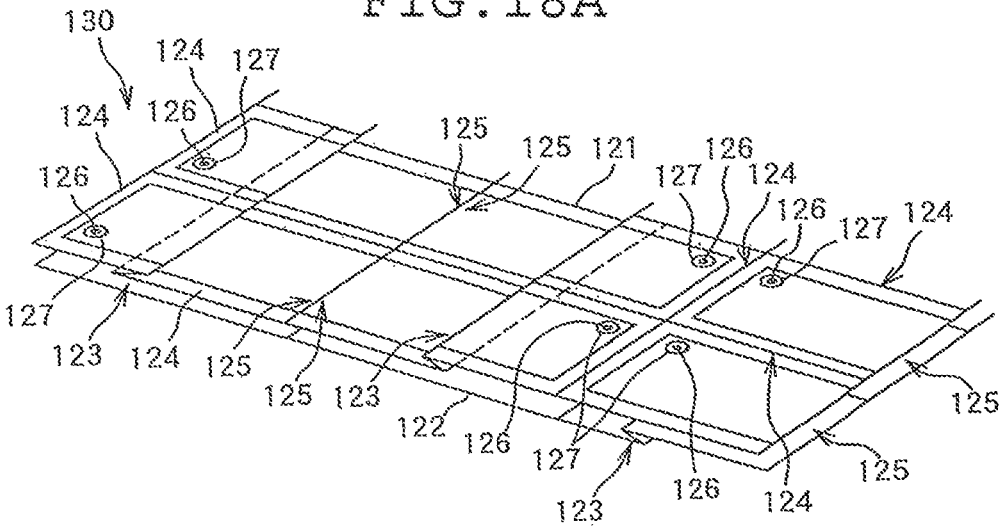
Figure 19A:
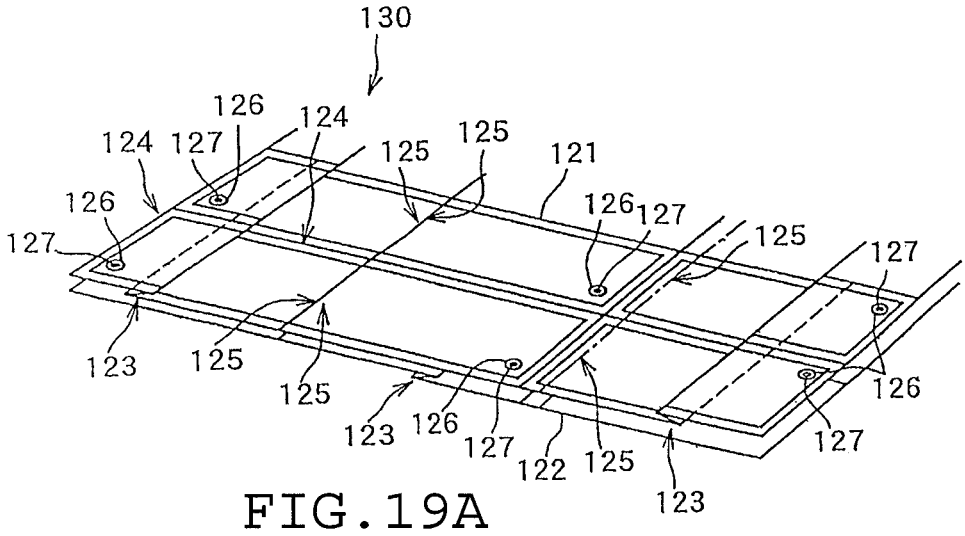
FIG. 19 is a schematic view explanatory of steps of a plastic pouch manufacturing method in accordance with another embodiment of the present invention and an area where a plastic pouch is severed.
Figure 19B:
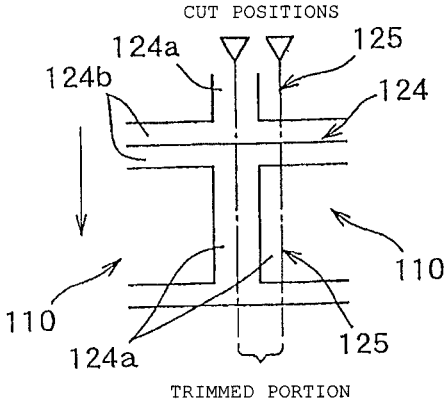

The manufacturing method 130 of FIGS. 18 and 19 is shown as applied to a three-row manufacturing line where three plastic pouches 110 are manufactured at a time. Where plastic pouches are manufactured by folding any one of the obverse and reverse surface members 121 and 122 at three separate portions thereof to provide three rows of folded-back sections 123, these plastic pouches can be manufactured through manufacturing steps similar to those in the already-described two-row manufacturing line, although not specifically shown.

In the case where plastic pouches are manufactured by folding any one of the obverse and reverse surface members 121 and 122 at three separate portions to provide three rows of folded-back sections 123, the folding at three separate portions need not necessarily be started at the same time. Timing for folding the three portions of the front or reverse surface member may be differentiated from one another; for example, the folding at one of the portions may be started after the folding at the other two portions has been started, in which case folded positions and folded amounts in the transverse or width direction of the front or reverse surface member 121 or 122 can be adjusted with ease.

In the case where the manufacturing method 130 is applied to the three-row manufacturing line and when folded-back sections 123 are to be formed on two portions of the obverse surface member 121 and on one portion of the rear surface member 122, if three rows of pouches are arranged in such a manner that opening portions 125, providing non-heat-sealed filling openings of two of the three pouches, are opposed to each other and heat-sealed bottom portions of one of these two pouches and the remaining one of the three pouches are opposed to each other as illustrated in (a) or (b) of FIG. 18, plastic pouches can be manufactured with folding directions of the two folded-back sections 123 on the obverse surface member 121 asymmetric to each other (in the illustrated example of (a) of FIG. 18) or symmetric to each other (in the illustrated example of (b) of FIG. 18).

In the illustrated example of (a) of FIG. 18, the one folded-back section 123 can be formed substantially on the center-line of the width direction of the reverse surface member 122, while, in the illustrated example of (b) of FIG. 18, the one folded-back section 123 can be formed on an end portion greatly deviated from the centerline of the width direction of the reverse surface member 122.

Further, in the case where the three pouches are arranged in such a manner that the non-heat-sealed opening portions 125 two of the three pouches are opposed each other and heat-sealed bottom portions of one of these two pouches and the remaining one of the three pouches are opposed to each other as illustrated in (a) or (b) of FIG. 18, and where the sealed surface members are cut, via a cutter unit, into individual pouches at the last step of the manufacturing line, it can avoid wasteful trimmed portions from being produced due to the cutting, thereby achieving efficient use of the plastic film laminate.

Further, where, in the three-row manufacturing line, two folded-back section 123 are formed on two separate portions of the obverse surface member 121 and one folded-back section 123 is formed on a portion of the reverse surface member 122, and if three rows of pouches are arranged in such a manner that the non-heat-sealed opening portions 125 of two of the pouches are opposed to each other while the bottom portion of a middle one of the pouches and the non-heat-sealed opening portion 125 of the remaining one of the pouches are opposed to each other as shown in, for example, in (a) of FIG. 19, the two folded-back section 123 can be formed on opposite widthwise end portions of the obverse surface member 121 and their respective folding directions can be set to be symmetric to each other, while the one folded-back section 123 can be formed on the centerline in the width direction of the reverse surface member 122.

Thus, even where tension is applied, in the feeding direction of the obverse and reverse surface members 121 and 122, by feed rollers etc., it is possible to form the folded-back sections 123 while uniformly distributing the tension in the width direction.

However, in the case where such arrangement of three rows of pouches is employed, and when the sealed surface members are cut, via the cutter unit, into individual pouches at the last step of the manufacturing line, it is necessary to cut the sealed surface members, at the portion where the central one heat-sealed bottom portion and the non-heat-sealed opening portion 125 are opposed each other, in such a manner that, as shown in FIG. 19(*b*), the heat-sealed portion 124 remains in the bottom portion while no heat-sealed portion 124 remains in the opening portion 125, which would produce a slight waste of the plastic film laminate due to the trimming.

The other manufacturing steps of the plastic pouch manufacturing method applied to the three-row manufacturing line can be performed in generally the same manner as in the above-described method applied to the two-row manufacturing line and thus will not be described here.

In the above-described manner, the instant embodiment of the manufacturing method can manufacture plastic pouches in the three-row manufacturing fashion, by forming three rows of folded-back sections 123 on the obverse and reverse surface members 121 and 122.

Next, a description will be given about still another embodiment of the plastic pouch manufacturing method, with reference to FIG. 20.

Figure 20A:
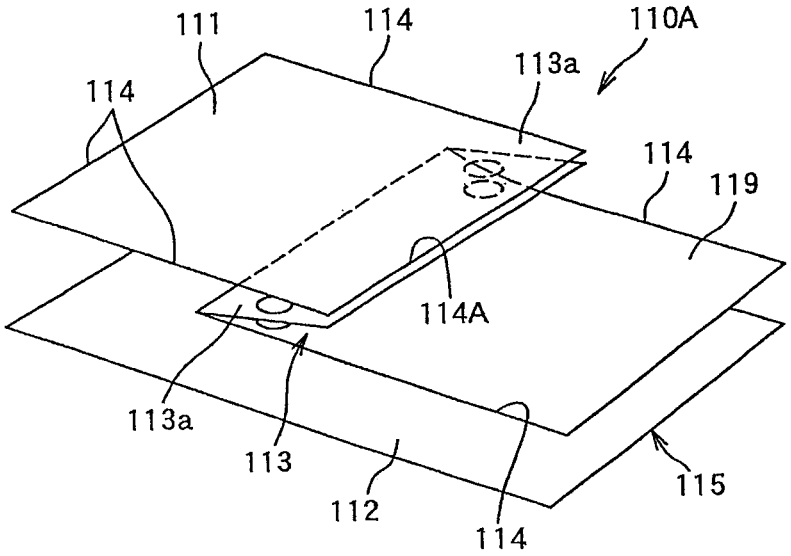
FIG. 20 is a view explanatory of a plastic pouch to be manufactured by a plastic pouch manufacturing method in accordance with still another embodiment of the present invention and steps of the manufacturing method.
Figure 20B:
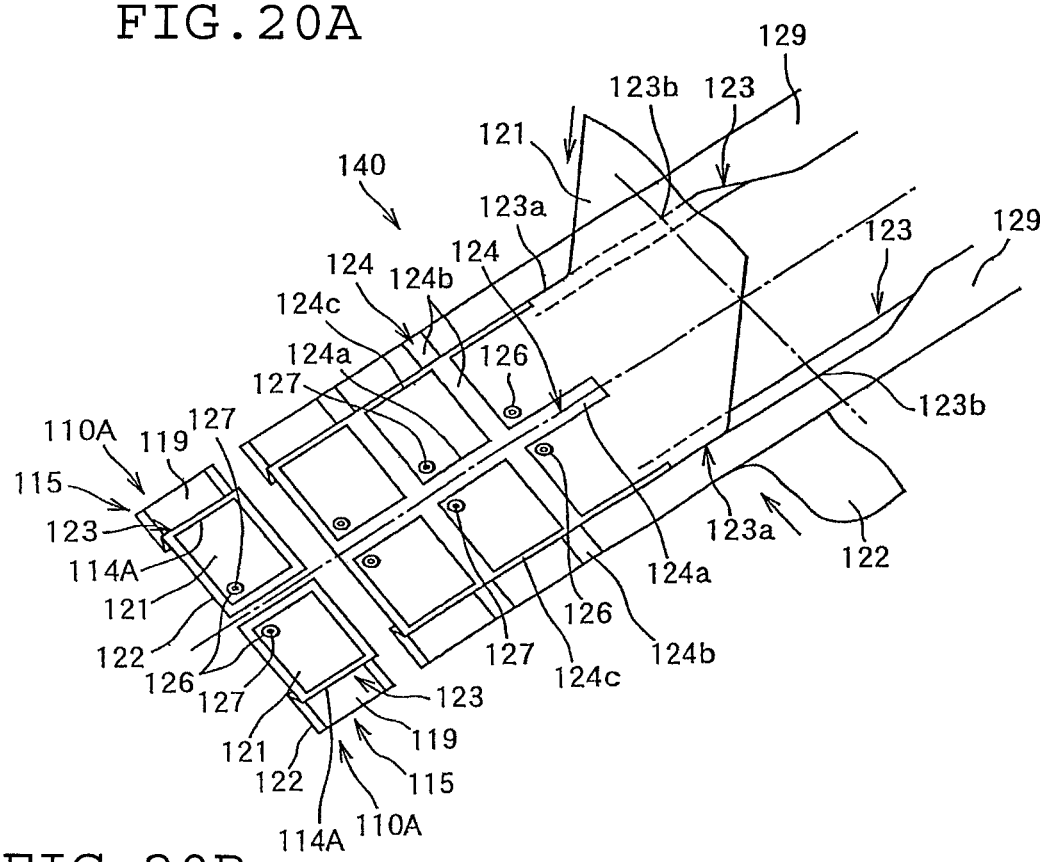

According to the manufacturing method 140 of FIG. 20, each plastic pouch 110A is made to include a folding-back surface member 119 in addition to an obverse surface member 111 and reverse surface member 112, and a distal end portion of a folded-back section 113 of the pouch is hermetically sealed by heat-sealing 114A.

Such a plastic pouch 110A can be made using, as a manufacturing line, facilities intended for manufacturing of a standing-type pouch, by providing the folding-back surface member 119 (129) instead of a bottom member.

Namely, where the manufacturing method 140 is applied to a two-row manufacturing line 120, for example, two separates plastic film laminates, each having a thermal adhesive capability in its inner surface, are supplied, and each end portion of each of the plastic film laminates is folded once to form the folded-back section 113. After that, holes 123*b* for fixing, by heat sealing, the opposite ends 123*a* of the folded-back section 123 are formed in two-layer overlapping portions at the opposite ends 123*a*.

The holes 123*b* for fixing, by heat-sealing, the opposite ends 123*a* of the folded-back section 123 may be formed on the same positions and in the same shape as described above.

Then, the obverse surface member 121 is superposed on the upper surface of the folding-back surface member 129, while the reverse surface member 122 is superposed on the lower surface of the folding-back surface member 129. After that, top sealing 124*c* of the folded-back section 123 as well as vertical and horizontal sealing 124*a* and 124*b* of peripheral edge portions of the pouch are effected by heat-sealing 124, but an opening portion 125, which will serve as a filling opening, is left in an opened state. Also, the ends 123*a* of the folded-back section 123 are fixed by the horizontal sealing 124*b* via the holes 123*b*.

With such heat-sealing, any portions to be sealed to provide a pouch can be appropriately sealed even where the folding-back surface member 129 is used as a separate member.

Subsequent heat-sealing for formation of the automatic opening portion and other openings, cutting of the sealed obverse and reverse surface members into each individual pouch may be performed in a similar manner to those in the above-described two-row manufacturing method 120.

In this case, where the sealed portion 124*c* is formed, by the heat-sealing 124, on the top portion of the folded-back section 123, there may be provided a trimming step, as necessary, for performing necessary trimming.

According to such a plastic pouch manufacturing method 140, the folded-back sections 123 are formed by the folding-back surface member 129 being supplied as a separate member as noted above, so that folded sections and holes 123*b* can be formed separately from the supply of the obverse and reverse surface members 121 and 122.

In place of the step of forming the holes 123*b*, there may be provided a step of applying an adhesive 128 to fix the ends 123*a* of each of the folded-back section 123. The ends 123*a* of each of the folded-back sections 123 may be fixed in any other suitable manner.

As having been described in detail in relation to various embodiments, the plastic pouch manufacturing method of the present invention is arranged to form the folded-back sections by folding a portion of either or both of the obverse and reverse surface members, and thus, it can readily form the folded-back sections 123 on the obverse and/or reverse surface members in the form of a web fed both continuously and intermittently. Thus, the method of the present invention can readily manufacture plastic pouches each having a folded-back section 123.

Further, according to the plastic pouch manufacturing method of the present invention, the folded-back sections can be formed with an even further ease by feeding the obverse and reverse surface members fed intermittently rather than continuously.

Furthermore, the plastic pouch manufacturing method of the present invention can facilitate manufacturing of plastic pouches in a two-row manufacturing line where plastic pouches are manufactured in two rows separate from each other in the width direction.

Furthermore, according to the plastic pouch manufacturing method of the present invention, it is possible to manufacture pouches by combining not only the obverse and reverse surface members but also the folding-back surface member, and thus, pouches, each including the folded-back section, can be manufactured using a conventional bag making machine for manufacturing standing-type pouches.

Furthermore, the plastic pouch manufacturing method of the present invention can facilitate manufacturing of plastic pouches in a three-row manufacturing line where plastic pouches are manufactured in three rows separate from one another in the width direction, by forming three folded-back sections on three portions of any one of the obverse and reverse surface members, or forming two folded-back sections on two portions of any one of the obverse and reverse surface members and one folded-back sections on one portion of the other of the obverse and reverse surface members.

Furthermore, according to the plastic pouch manufacturing method of the present invention, it is possible to readily manufacture plastic pouches, each having a folded-back section, irrespective of the folded-back direction of the folded-back sections, by forming the folded-back sections in the same or different folded-back directions or a combination thereof.

Furthermore, according to the plastic pouch manufacturing method of the present invention, it is possible to readily form the folded-back sections even on the surface member to which tension is applied, by forming the folded-back sections at differentiated timing (one after another) rather than at the same time, with the result that pouches, each including the folded-back section, can be manufactured with ease.

Furthermore, according to the plastic pouch manufacturing method of the present invention, the widthwise opposite ends of the folded-back section, located outwardly of the sealed portions, can be fixed with ease by forming holes in portions of the two surface member portions sandwiched between the folded-back sections and fixing the opposite ends by heat sealing; thus, the opposite ends of each of the folded-back sections can be fixed with the inner surfaces of the obverse and reverse surface members held in direct contact with each other and heat-sealed together through the holes thus formed in the two surface members.

Furthermore, according to the plastic pouch manufacturing method of the present invention, the formation of the holes is performed during a continuous or intermittent feed of the obverse and reverse surface members or folding-back surface member; thus, the folded-back sections can be formed with each by forming the holes and performing the heat-sealing irrespective of whether the surface members are fed continuously or intermittently.

Furthermore, according to the plastic pouch manufacturing method of the present invention, the widthwise opposite ends of the folded-back section, located outwardly of the sealed portions, can be fixed with ease by any one of an adhesive, mechanical fixation and welding.

Moreover, according to the plastic pouch manufacturing method of the present invention, the automatic opening portion that can be automatically opened in response to an internal vapor pressure can be readily formed in a position located inwardly of the heat-sealed peripheral edge portions, and such an automatic opening portion allows heating by a microwave oven to be performed safely and with ease.

Moreover, according to the plastic pouch manufacturing method of the present invention, it is possible to readily form the automatic opening portion by forming a head-sealed portion simultaneously with the heat-sealing of peripheral edge portions and then forming a through-hole in the head-sealed portion.

Next, a description will be made about an embodiment of a plastic pouch manufacturing/packing method of the present invention, with reference to the drawings.

First, a plastic pouch, to which the plastic pouch manufacturing/packing method of the present invention is applied, will be described with reference to FIG. 22.

Figure 22A:
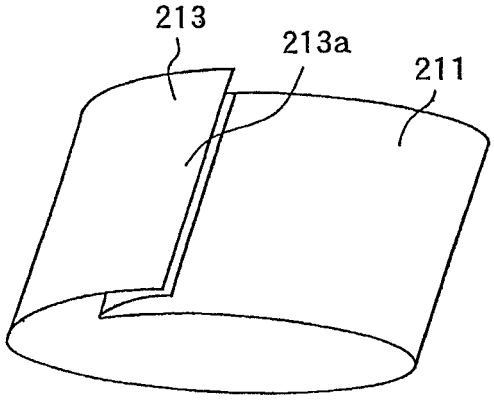
FIG. 22 shows a plastic pouch to be manufactured in accordance with the present invention, where (a) is a perspective view of a film member, (b) is a bottom view of the pouch in an assembled state, (c) is a perspective view of the pouch heated by a microwave oven.
Figure 22B:
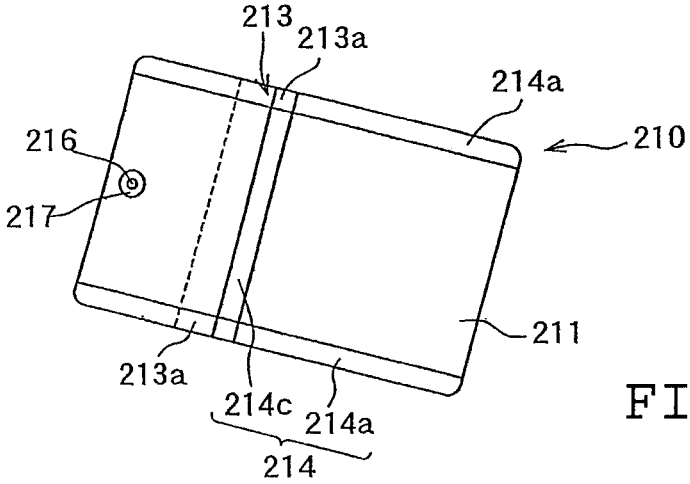
Figure 22C:
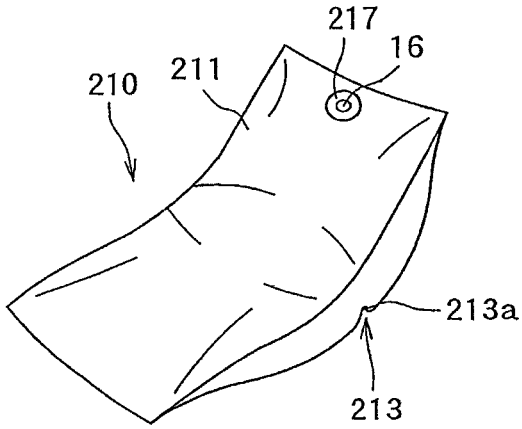

In FIG. 22 showing the plastic pouch, (a) is a perspective view of a film member, (b) is a bottom view of an assembled pouch, and (c) is a perspective view of the pouch heated by a microwave oven.

This plastic pouch 210 is formed of the film member 211, and a folded-back section 213 is formed by folding back, in a substantial Z configuration, the film member 211 along a line extending widthwise (in a longitudinally-intermediate area of the film member 211) at right angles to opposite side edges of the member 112. Peripheral-edge sealed portion 214 is formed by leading-end heat-sealing 214*a* and heat-sealing of a sealing portion 214*c* of the folded-back section 213.

Further, in this plastic pouch 210, opposite widthwise ends 213*a* of the folded-back section 213, located outwardly of the sealed portion 214, are fixed to the film member 211.

In a case where contents that have to be heated by a microwave oven are to be packed into the pouch, for example, an automatic opening portion 216 that automatically opens in response to an increase in the interior pressure of the pouch is formed, as necessary, as a through-hole passing through a heat-sealed portion 217. For example, the heat-sealed portion 217 is formed separately from the peripheral sealed portion 214, and the opening 216 is formed in this heat-sealed portion 217.

In the pouch 210, the folded-back section 213 communicating with the interior of the flat-type pouch is provided widthwise on an intermediate portion of the film member 211 communicating with the interior of the pouch, so that, as the folded-back section 213 is swollen by the increased interior pressure of the pouch, a portion of the film member 211, extending widthwise at right angles to the opposite sides, can have an increased length and thus can easily rise upward. As a result, in the case where the pouch has the automatic opening portion 216, the opening 216 can be held at a high position (see (c) of FIG. 22).

Figure 21A:
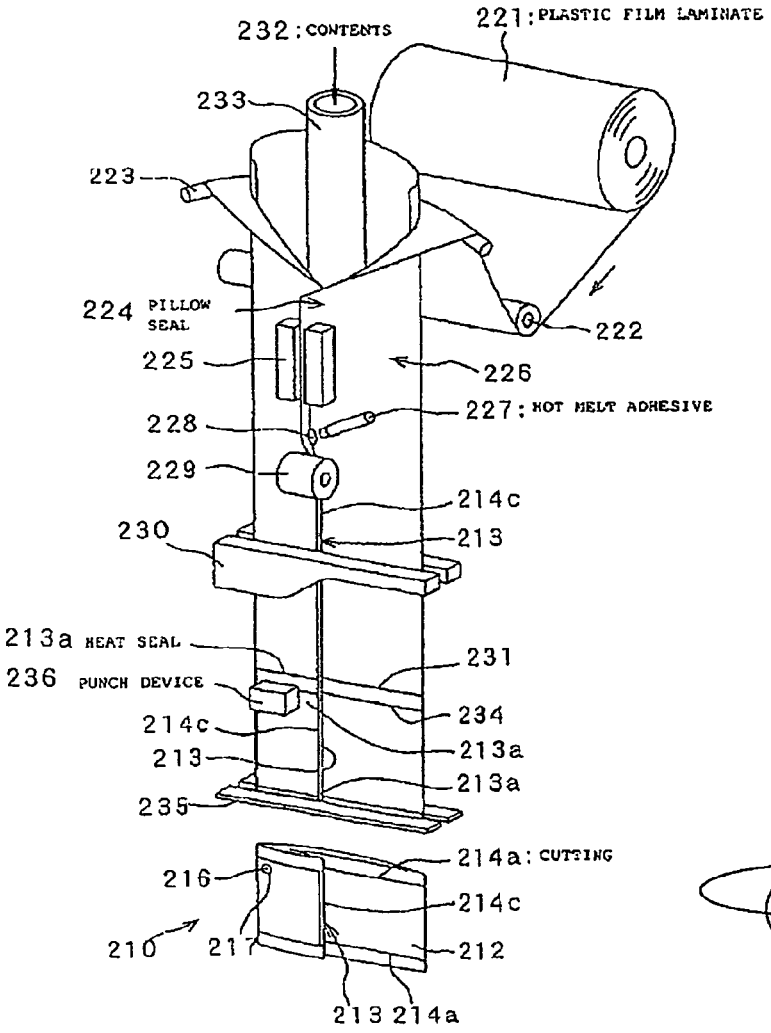
FIG. 21 is a schematic view and a fragmentary enlarged view of a manufacturing line according to an embodiment of a plastic pouch manufacturing/packing method of the present invention.
Figure 21B:
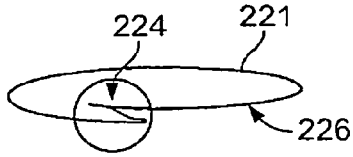
Figure 21B:
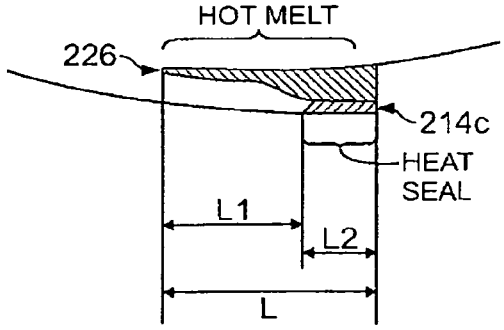

With reference to FIG. 21, the following paragraphs describe the manufacturing/packing method for manufacturing a plastic pouch 210 but also filling the plastic pouch 210 with desired contents.

The manufacturing/packing method is arranged to pack the desired contents into the plastic pouch 210 of FIG. 22 while making the pouch 210 by feeding the pouch 210 in a posture where the wide sides of the pouch are oriented vertically while the narrow sides are oriented horizontally. Folded-back section 213 will be formed along the pouch feeding direction.

According to the manufacturing/packing method of the present invention, a plastic film laminate 221, having a thermal adhesive capability in its inner surface, is unrolled or played out and led, via a plurality of supply rollers 222, to a former 223. During passage through the former 223, the plastic film laminate 221 is curved into a cylindrical shape, and then opposite side edge portions of the cylindrically-curved film laminate 221 are superposed on each other to provided a superposed section 224.

Proximal end of the superposed section 224 is bent at a subsequent step. As shown in (b) of FIG. 21, a length L measured from the bent proximate end of the superposed section 224 has a length L is equal to a sum of a length L1 of the folded-back section 213 of the pouch 210 and a length L2 of the sealing section 214*c* necessary for closing and sealing the leading end of the folded-back section 213 at this step. Namely, the length of the superposed section 224 is greater, by the length L1 of the folded-back section 213, than a superposed section of a conventional pillow package.

Once the superposed section 224 is delivered to a pillow seal device 225, only the leading end of the superposed section 224 is pillow-sealed to thereby provide a continuous, substantially-cylindrical structure 226.

Then, an adhesive 228, such as a hot-melt adhesive, is applied, via an adhesive application device 27, to the opposite ends 213*a* of the folded-back section 213 of the plastic pouch 210, which will be bent inward, at a subsequent step, from the proximal end, in the superposed section 224 of the substantially-cylindrical structure 226; in this case, the adhesive 228 is applied at intervals corresponding the width of the plastic pouch 210 in use condition of the pouch.

After that, the superposed section 224 of the substantially-cylindrical structure 226 is delivered to a pressing roller 229, by which it is pressed so that the surface having the adhesive 228 applied thereto is bent inward from the proximal end and the opposite ends 213*a* of the folded-back section 213 are adhesively fixed.

After such formation of the substantially-cylindrical structure 226 having the folded-back section 213 with its opposite ends 213*a* fixed together, the leading end of the substantially-cylindrical structure 226 is subjected to leading-end sealing 231 by a heat-seal device 230, and the thus heat-sealed leading end forms one of the leading-end seals 214*a*.

After that, desired contents 232 are packed into the substantially-cylindrical structure 226 closed at its leading end via the leading-end seal 231, and then the trailing end is subjected to trailing-end sealing 231 by the heat-seal device 230; the thus heat-sealed trailing end forms the other of the leading-end seals 214*a*. In this manner, the plastic pouch 210 is hermetically sealed with the contents packed therein.

After that, the plastic film laminate 221 is cut, via the heat-seal device 230, at a position thereof behind the trailing-end seal 234, to thereby provide a separated plastic pouch 21.

In manufacturing such successive plastic pouches 210 and packing the contents into the individual plastic pouches 210, the trailing-end sealing 234 of a preceding one of every pair of successive plastic pouches 210 and the leading-end sealing 231 of the succeeding plastic pouch 210 are performed simultaneously by the heat-seal device 230.

Further, in each of the plastic pouches 210, an automatic opening portion 216 that can open in response to a vapor pressure in the interior of the pouch 210 is formed in the plastic film laminate 221. Namely, the heat-sealed portion 217 is formed by the heat seal device 230 simultaneously with the leading-end sealing 231 and trailing-end sealing 234 and then a through-hole is formed in the heat-sealed portion 217, to thereby provide the automatic opening portion 216.

With the automatic opening portion 216 thus formed, the inner pressure increased due to heating by the microwave oven can be automatically evacuated through the automatic opening portion 216.

As has been described in detail above, the plastic pouch manufacturing/packing method of the present invention is arranged to superpose the opposite widthwise end edge (i.e., side edge) portions of the plastic film 221 and then perform sealing of the folded-back section 213 and sealing section 214*c* at the leading end of the folded-back section 213 by means of the pillow-seal device 225; with these arrangements, the method of the present invention can manufacture a pouch 210 including the folded-back section 213. Further, the method of the present invention can pack desired contents 232 while manufacturing the plastic pouch 210, by packing the contents 232 in the interior of the pouch between the leading-end seal 231 and the trailing-end seal 234. As a result, the manufacturing/packing method of the present invention can perform the plastic pouch manufacturing and contents packing with utmost efficiency.

Further, according to the plastic pouch manufacturing/packing method of the present invention, where the opposite ends 213*a* of the folded-back section 213 are fixed together by applying the adhesive 228 prior to folding of the superposed section 224, the fixation of the opposite ends 213*a* of the folded-back section 213 can be easily performed by just folding the superposed section 224 after application of the adhesive 228.

Further, according to the plastic pouch manufacturing/packing method of the present invention, the trailing-end sealing 234 of the substantially-cylindrical structure 226 of the preceding plastic pouch and the leading-end sealing 231 of the substantially-cylindrical structure 226 of the succeeding plastic pouch are performed simultaneously. As a result, the plastic pouch manufacturing and contents packing can be carried out with utmost efficiency.

Furthermore, according to the plastic pouch manufacturing/packing method of the present invention, the automatic opening portion 216 that can open in response to a vapor pressure in the interior of the pouch 210 allows the inner pressure, increased due to heating by the microwave oven, to be automatically evacuated therethrough.

Furthermore, according to the plastic pouch manufacturing/packing method of the present invention, the automatic opening portion 216 is provided by forming, via the heat-seal device 230, the heat-sealed portion 217 simultaneously with the leading-end sealing 231 and trailing-end sealing 234 and then forming a through-hole in the heat-sealed portion 217 via a punch device 236. Thus, the method of the present invention can readily provide the automatic opening portion 216.

Whereas the above-described embodiment is constructed to fix the opposite ends 213*a* of the folded-back section 213 by the adhesive 228, the present invention is not so limited; for example, the opposite ends 213*a* can also be fixed easily by a mechanical means, such as a stapler or rivet, or by welding based on supersonic sealing.

INDUSTRIAL APPLICABILITY

The plastic pouch of the present invention can be suitably used as a microwave-cooking pouch for packing therein retort food, in liquid or solid form or in a mixture of liquid and solid materials.

The invention claimed is:

1. A method for manufacturing a plastic pouch including a widthwise folded-back section provided on at least one position of an obverse surface member and reverse surface member in communication with an interior of the plastic pouch, peripheral edge portions of the pouch being heat-sealed, and opposite widthwise ends of said folded-back section, located outwardly of sealed portions of said folded-back section, being fixed to said obverse surface member or said reverse surface member, characterized in that said method comprises forming said folded-back section by folding one portion of at least one of said obverse surface member and said reverse surface member so two inner surface member portions are sandwiched between said obverse surface member and said reverse surface member, and fixing said surface members between said obverse surface member and said reverse surface member wherein the opposite widthwise ends of said folded-back section, located outwardly of the sealed portions of said folded-back section, are fixed, by forming holes in two portions of the surface members sandwiched between said obverse surface member and said reverse surface member and then heat-sealing the opposite widthwise ends, and said obverse surface member and said reverse surface member being film laminates having an inner surface with a thermal adhesive capability on said inner surface.

2. A method for manufacturing a plastic pouch as claimed in claim 1 wherein formation of said folded-back section is performed on the at least one of said obverse surface member and said reverse surface member that are fed continuously.

3. A method for manufacturing a plastic pouch as claimed in claim 1 wherein formation of said folded-back section is performed on the at least one of said obverse surface member and said reverse surface member after continuous feeding of the at least one of said obverse surface member and said reverse surface member is converted into intermittent feeding.

4. A method for manufacturing a plastic pouch as claimed in claim 1 wherein formation of said folded-back section is performed on two portions of any one of said obverse surface member and said reverse surface member, or on one portion of each of said obverse surface member and said reverse surface member, so as to manufacture plastic pouches in two rows.

5. A method for manufacturing a plastic pouch as claimed in claim 4 wherein formation of said folded-back section is performed at differentiated timing.

6. A method for manufacturing a plastic pouch as claimed in claim 1 wherein formation of said folded-back section is performed on three portions of any one of said obverse surface member and said reverse surface member, or on two portions of any one of said obverse surface member and said reverse surface member and on one portion of other of said obverse surface member and said reverse surface member, so as to manufacture plastic pouches in three rows.

7. A method for manufacturing a plastic pouch as claimed in claim 6 wherein formation of said folded-back section is performed at differentiated timing.

8. A method for manufacturing a plastic pouch as claimed in claim 1 wherein the folded-back sections of individual plastic pouches to be manufactured are formed using a same folding direction or different folding directions or a combination of the same folding direction and different folding directions.

9. A method for manufacturing a plastic pouch as claimed in claim 1 wherein said holes are formed in each of the two portions of the surface members or in the folding-back surface member, or formed to extend over the two portions of the surface members.

10. A method for manufacturing a plastic pouch as claimed in claim 1 wherein formation of said holes is performed during continuous feeding or intermittent feeding of said obverse surface member and said reverse surface member.

11. A method for manufacturing a plastic pouch as claimed in claim 1 wherein fixation of the opposite widthwise ends of said folded-back section, located outwardly of the sealed portions of said folded-back section, is performed, by any of an adhesive agent, mechanical fixation and welding.

12. A method for manufacturing a plastic pouch as claimed in claim 1 which further comprises forming an automatic opening portion that can open in response to a vapor pressure within the pouch is formed inwardly of a heat-sealed peripheral edge portion of the plastic pouch such that the automatic opening portion is positioned at a portion other than the folded back section.

13. A method for manufacturing a plastic pouch as claimed in claim 12 wherein said automatic opening portion is formed by forming a heat-sealed portion simultaneously with heat-sealing of the peripheral edge portion of the pouch and then forming a through-hole in the heat-sealed portion.

14. A method for manufacturing a plastic pouch including a widthwise folded-back section provided on a folding-back surface member and at least one position of an obverse surface member and reverse surface member in communication with an interior of the plastic pouch, peripheral edge portions of the pouch being heat-sealed, and opposite widthwise ends of said folded-back section, located outwardly of sealed portions of said folded-back section, being fixed to said obverse surface member or said reverse surface member, characterized in that said method comprises forming said folded-back section by folding one portion of said folding-back surface member so that two inner surface member portions of said folding-back surface member are sandwiched between said obverse surface member and said reverse surface member, and fixing said surface members between said obverse surface member and said reverse surface member wherein the opposite widthwise ends of said folded-back section, located outwardly of the sealed portions of said folded-back section, are fixed, by forming holes in two portions of the surface members sandwiched between said obverse surface member and said reverse surface member and then heat-sealing the opposite widthwise ends, and said obverse surface member and said reverse surface member being film laminates having an inner surface with a thermal adhesive capability on said inner surface.

* * * * *